US006330808B1

(12) United States Patent
Kouwenberg et al.

(10) Patent No.: US 6,330,808 B1
(45) Date of Patent: Dec. 18, 2001

(54) DEVICE FOR REGULATING THE TEMPERATURE OF A CONTAINER

(75) Inventors: Tineke C Kouwenberg; Robert J Kouwenberg; Soren Petersen; Michael T Wall, all of County Cork; David L Morgan, County Wicklow; Cathal Loughnane, County Tipperary, all of (IE)

(73) Assignee: Tineke Charlotte Kouwenberg, County Cork (IE)

( * ) Notice: Subject to any disclaimer, the term of this patent is extended or adjusted under 35 U.S.C. 154(b) by 0 days.

(21) Appl. No.: 09/355,747

(22) PCT Filed: Feb. 3, 1998

(86) PCT No.: PCT/IE98/00005

§ 371 Date: Apr. 10, 2000

§ 102(e) Date: Apr. 10, 2000

(87) PCT Pub. No.: WO98/33421

PCT Pub. Date: Aug. 6, 1998

(30) Foreign Application Priority Data

Feb. 4, 1997 (IL) ..... 97 0067

(51) Int. Cl.[7] ..... F25D 3/08

(52) U.S. Cl. ..... 62/372; 62/457.8; 62/530; 62/457.4

(58) Field of Search ..... 62/457.8, 530, 62/372, 457.4

(56) References Cited

U.S. PATENT DOCUMENTS 714,415 * 11/1902 Trafford ..... 62/457.8
735,403 * 8/1903 Osborne ..... 62/457.8
1,671,531 * 5/1928 Kuhl ..... 62/457.8
4,164,851 * 8/1979 Bryant ..... 62/381
4,232,532 * 11/1980 Marsh ..... 62/457
4,393,665 * 7/1983 Gardner et al. ..... 62/457
4,531,381 * 7/1985 Toro et al. ..... 62/372
4,597,435 * 7/1986 Fosco, Jr. ..... 165/80.5
4,711,099 * 12/1987 Polan et al. ..... 62/457
4,809,522 * 3/1989 deNevers et al. ..... 62/457
4,825,665 * 5/1989 Micallef ..... 62/372
5,845,514 * 12/1998 Clarke et al. ..... 62/373
6,082,114 * 7/2000 Leonoff ..... 62/3.64

* cited by examiner

*Primary Examiner*—William Doerrler
*Assistant Examiner*—Mark S. Shulman
(74) *Attorney, Agent, or Firm*—Sughrue, Mion, Zinn, Macpeak & Seas, PLLC

(57) ABSTRACT

A cooling device (1) for chilling a wine bottle (2) comprises a substantially cylindrical housing (3). A panel member (8) formed by a plurality of hingedly connected panel segments (9) is located in the housing (3) and forms a receiving compartment (12) for the wine bottle (2). The panel segments (9) each form a storing chamber (14) for storing a temperature conditionable liquid. An annular ring (7) is mounted on a carrier sleeve (16) which is rotatable and axially slideable within the housing (3) for varying the diameter of a receiving compartment (12) for accommodating bottles (2) of different diameter. A bearing rim (20) of the carrier sleeve (16) abuts wedge-shaped portions (21) of the panel member (8) so that as the carrier sleeve (16) is urged axially into the housing (3) the diameter of the receiving compartment (12) is reduced and vice versa. Cam slots (30) in the carrier sleeve (16) co-operate with cam followers (24) in the housing (3) for causing the carrier sleeve (16) to move axially in the housing (3) on rotation of the annular ring (7).

41 Claims, 19 Drawing Sheets

DEVICE FOR REGULATING THE TEMPERATURE OF A CONTAINER

Figure 1:
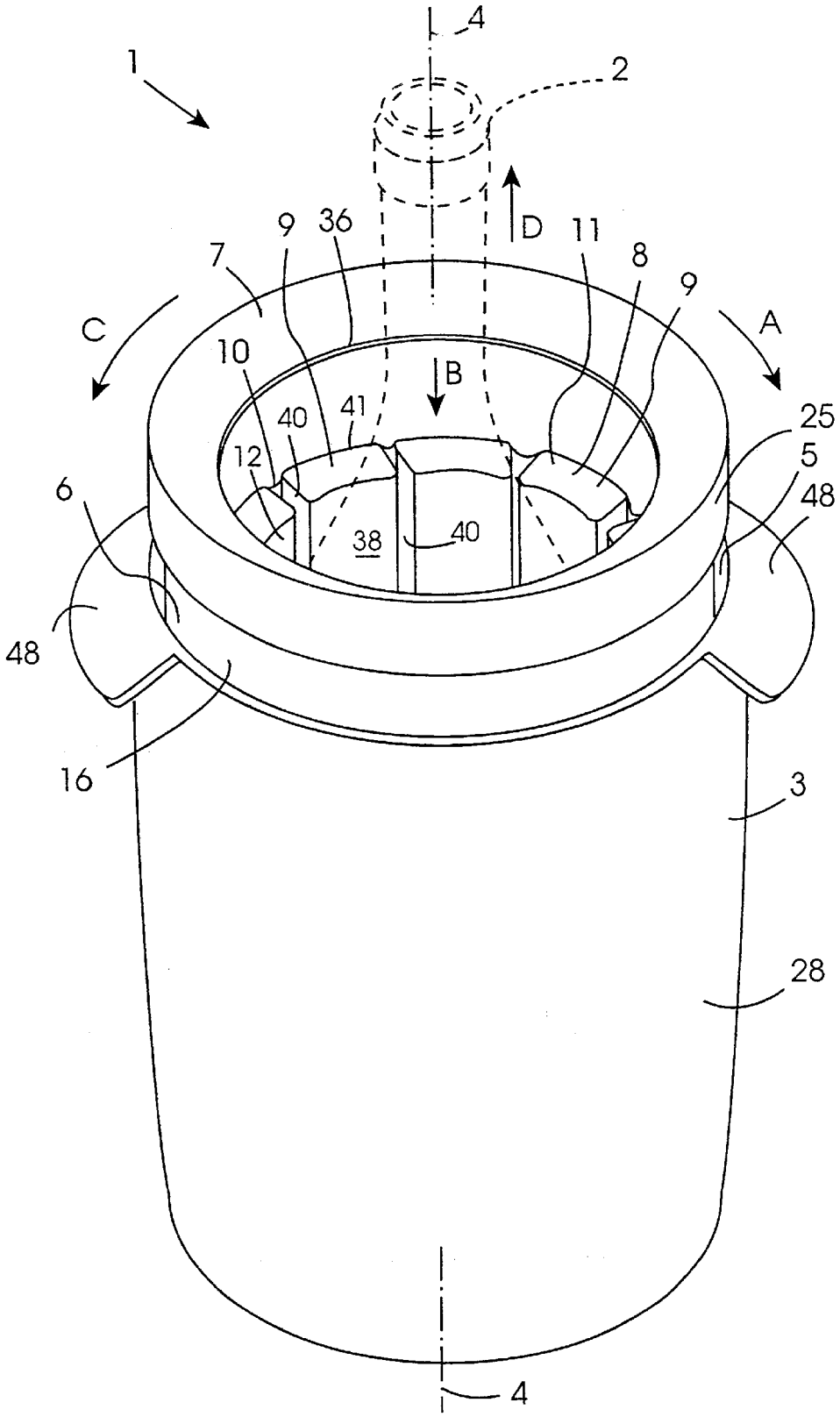

The present invention relates to a device for regulating the temperature of the contents of a container, for example, a beverage container, such as a can, bottle or the like, for example, a wine bottle.

It is desirable that white wines, champagne, and other such beverages, as well as beer and the like should be served chilled. In general, it is not feasible in a restaurant environment to maintain an entire stock of white wines and champagnes at the desired chilled temperature. Restaurateurs tend to store the more popular white wines in a cool cabinet which maintains the temperature of those wines at the desired chilled temperature. However, when a less popular wine is requested, it is necessary to chill the wine from room temperature to the desired chilled temperature. This, in general, is achieved by immersing the bottle of wine in an ice bucket or the like. Needless to say, this can be inconvenient, and in general, the time required to chill the wine to the desired chilled temperature from room temperature is excessive. Additionally, in a restaurant environment, the temperature of a bottle of wine already chilled, if left on a table for any length of time tends to rise while the diners are partaking of their meal, and towards the end of the meal, the temperature of the wine may have risen to an undesirably high temperature. To overcome this problem, it is common to keep the wine bottle immersed in an ice bucket for the duration of the meal, or alternatively, to place the wine bottle in a flask type device which comprises a container having an inner compartment for receiving the wine bottle, surrounded by a double skinned wall, and the area between the skins of the wall is evacuated. While such flask type devices do tend to retard the rate at which the temperature of the wine rises, in general, they tend to be relatively unsatisfactory, and besides, if the wine is placed in the flask type device before it has been reduced to the desired temperature, these flask type devices have no cooling facility, and thus, the temperature of the wine commences to slowly rise from its temperature when initially placed in the flask device.

U.S. Pat. No. 4,768,354 of Barnwell discloses a device for cooling a beverage can, such as, a beverage beer can. The device comprises a cylindrical container having a base and a cylindrical side wall extending upwardly from the base. The side wall is of an insulating material, and defines with the base a hollow interior region of circular transverse cross-section. A sleeve-like insert is located within the hollow interior region and extends around the inner side of the side wall for receiving the can. The sleeve-like insert forms an annular storing chamber within which a temperature conditionable liquid is stored for chilling the contents of the beverage can when the beverage can is inserted into the sleeve-like insert. The sleeve-like insert is removeable from the container for placing in a freezer or a deepfreezer for chilling or freezing the temperature conditionable liquid in the storing chamber. On the temperature conditionable liquid being frozen or chilled to the desired temperature, the sleeve-like insert is then inserted in the container and the beverage can is in turn inserted into the sleeve for chilling thereof.

While the device of U.S. Pat. No. 4,768,354 chills the contents of a beverage can to a desired chill temperature, nonetheless, the device suffers from a number of disadvantages, firstly, the device of the U.S. Specification provides little control over the temperature of the contents of the beverage can. In general, once the contents of the beverage can have been chilled to the desired temperature, it is essential to remove the beverage can from the container, otherwise chilling continues, and the temperature of the contents of the beverage can are reduced to an unacceptably low temperature. This is particularly so if it is desired to chill the contents of the beverage can relatively rapidly. In such a case, it is essential that the temperature of the temperature conditionable liquid in the sleeve-like insert be reduced to a temperature, which is significantly lower than the temperature to which it is desired to chill the contents of the beverage can. Thus, should the beverage can be left in the container after its contents have reached the desired chilled temperature, further chilling continues, and thus, the contents of the beverage can are reduced to an unacceptably low temperature. Alternatively, if the temperature conditionable liquid of the sleeve-like insert is chilled to a temperature which would be such that when the contents of the beverage can are at the desired chilled temperature, the temperature of the temperature conditionable liquid is in equilibrium with the beverage temperature in order to avoid chilling of the contents of the beverage can below the desired chilled temperature, the time required to reduce the temperature of the contents of the beverage can, in general, is unacceptably long. Another problem with the device of U.S. Pat. No. 4,768,354 is that it is only suitable for use with a beer can of a specific size.

There is therefore a need for a device for chilling the contents of containers, for example, beverage containers of various sizes to a desired chill temperature. Indeed, there is also a need for a device for regulating the temperature of the contents of containers of various sizes, whether the temperature is to be regulated upwardly or downwardly.

The present invention is directed towards providing such a device for regulating the temperature of the contents of a container.

According to the invention there is provided a device for regulating the temperature of the contents of a container, the device comprising a support means, and a temperature regulating means located within the support means for regulating the temperature of the contents of the container at a desired temperature, the temperature regulating means comprising a storing means for storing a temperature conditionable fluid and defining an elongated receiving compartment for receiving the container, wherein the receiving compartment is of variable transverse cross-sectional area for accommodating containers of different cross-sectional area.

In one embodiment of the invention the transverse cross-sectional area of the receiving compartment is variable for facilitating operation of the device in a first mode with the temperature regulating means abutting the container for altering the temperature of the contents of the container, and in a second mode with the temperature regulating means spaced apart from the container for maintaining the temperature of the contents of the container substantially constant.

Ideally, the receiving compartment defines a central axis which in use substantially coincides with the central axis of the container. Preferably, the receiving compartment is in the form of an elongated receiving bore. Advantageously, the receiving compartment is of circular transverse cross-sectional area.

In one embodiment of the invention the support means is co-operable with the temperature regulating means for varying the transverse cross-sectional area of the receiving compartment.

In another embodiment of the invention a means for varying the transverse cross-sectional area of the receiving compartment is provided. Preferably, the means for varying the transverse cross-sectional area of the receiving compartment is co-operable with the support means and the temperature regulating means for varying the transverse cross-sectional area of the receiving compartment.

In one embodiment of the invention the support means comprises a first part and a second part which are moveable relative to each other. Preferably, the first part of the support means comprises a hollow housing which forms a container defining a hollow interior region for receiving the temperature regulating means therein, the housing defining a longitudinally extending central axis which substantially coincides with the central axis of the receiving compartment, and the second part of the support means comprises an annular ring located co-axially with the housing.

In one embodiment of the invention the means for varying the transverse cross-sectional area of the receiving compartment comprises a first element located on the second part of the support means and a second element located on the temperature regulating means so that on relative movement of one of the first and second parts of the support means the first and second elements co-operate with each other for varying the transverse cross-sectional area of the receiving compartment. Preferably, the first element is moveable relative to the second element for varying the transverse cross-sectional area of the receiving compartment as the one of the first and second parts of the support means is moved relative to the other. Advantageously, the second element is shaped so that movement of the first element relative to the second element varies the transverse cross-sectional area of the receiving compartment.

In one embodiment of the invention a constraining means is provided for constraining the first element to move in a predetermined path relative to the second element for varying the transverse cross-sectional area of the receiving compartment when the one of the first and second parts of the support means is moved relative to the other.

In another embodiment of the invention the first and second parts of the support means are rotatably moveable relative to each other, and the constraining means constrains the first element to move relative to the second element along the predetermined path parallel to the central axis.

In a further embodiment of the invention the constraining means comprises a cam drive means having a camming means located on one of the first and second parts of the support means, and a cam follower means located on the other of the first and second parts of the support means, the cam follower means being co-operable with the camming means for constraining the first element to move in the predetermined path relative to the second element for varying the transverse cross-sectional area of the receiving compartment on one of the first and second parts of the support means being moved relative to the other.

Preferably, the annular ring is rotatably moveable relative to the housing for causing the first element to move relative to the second element along the predetermined path. Advantageously, the annular ring is rotatably moveable relative to the housing from a first angular position with the receiving compartment of the temperature regulating means being of maximum transverse cross-sectional area to a second angular position with the receiving compartment of the temperature regulating means being of minimum transverse cross-sectional area.

In one embodiment of the invention the housing comprises a base and an upwardly extending side wall which defines an open mouth to the hollow interior region, the side wall defining the central axis of the hollow interior region, and the annular ring being located above the housing adjacent the open mouth.

In another embodiment of the invention a carrier means extends from the annular ring into the hollow interior region of the housing for carrying the first element. Preferably, the carrier means carries one of the camming means and the cam follower means, and the other of the camming means and the cam follower means is carried on the housing.

Advantageously, the camming means is provided by a cam slot formed in the carrier means, the cam slot extending partially circumferentially around the carrier means and defining a cam profile for engagement with the cam follower so that rotation of the annular ring and the carrier means relative to the housing constrains the carrier means to move parallel to the central axis of the receiving compartment for varying the transverse cross-sectional area of the receiving compartment. Preferably, the cam follower is located on the housing and extends inwardly into the hollow interior region for engaging the cam profile defined by the cam slot. Advantageously, a plurality of cam followers are equispaced apart circumferentially around the housing, and a corresponding number of cam slots are also provided equispaced apart around the carrier means.

Ideally, each cam slot defines an inclined cam profile relative to the central axis of the receiving compartment.

Preferably, an entry slot is provided to each cam slot for facilitating exiting and entry of the corresponding cam follower into the cam slot on removal or replacement of the annular ring and carrier means relative to the housing. Advantageously, the entry slots communicate with the corresponding cam slots at the end of the cam slots remote from the annular ring and extend in an axial direction away from the annular ring towards the free end of the carrier means.

Preferably, the carrier means extends from the annular ring into the hollow interior region of the housing, and advantageously, the carrier means is located between the housing and the temperature regulating means.

In one embodiment of the invention the carrier means comprises a carrier side wall extending from the annular ring between the housing and the temperature regulating means, the carrier side wall terminating in a bearing rim at its free end remote from the annular ring which forms the first element. Preferably, the bearing rim extends completely around the carrier side wall, and is formed on a portion of the carrier side wall extending inwardly towards the temperature regulating means.

In another embodiment of the invention the temperature regulating means defines a pair of free end edges extending parallel to the central axis of the receiving compartment, the free end edges being moveable relative to each other for varying the transverse cross-sectional area of the receiving compartment.

Ideally, the temperature regulating means comprises a panel member formed into a sleeve for forming the receiving compartment, the panel member comprising a pair of opposite longitudinally extending free end edges extending parallel to the central axis of the receiving compartment which form the end edges.

Preferably, the panel member comprises a plurality of elongated panel segments extending parallel to the central axis of the receiving compartment, each panel segment defining an inner face and an opposite outer face which are joined by a pair of opposite longitudinally extending end faces, each panel segment being connected to its adjacent panel segment by a connecting means, the inner faces of the respective panel segments defining the receiving compartment, and the end faces of the panel segments at respective opposite ends of the panel member defining the respective free end edges of the panel member. Advantageously, each panel segment defines a discrete storing chamber for forming the storing means for storing the temperature conditionable fluid.

Preferably, the connecting means for connecting adjacent panel segments is a resilient connecting means for urging the panel member outwardly relative to the central axis of the receiving compartment. Advantageously, each connecting means comprises a longitudinally extending plastics hinge. Preferably, each connecting means is located intermediate the inner and outer faces of the adjacent panel segments.

In one embodiment of the invention the end faces of the respective panel segments between the connecting means and the inner faces of the panel segments are chamfered for accommodating hinging of the panel segments relative to each other for forming the receiving compartment.

In another embodiment of the invention the outer faces of the panel segments define an outer wall of the temperature regulating means, each outer face defining the second element for co-operating with the first element for varying the transverse cross-sectional area of the receiving compartment. Preferably, each second element defined by the outer face of each panel segment is of wedge-shape in a direction parallel to the central axis of the receiving compartment so that axial movement of the first element relative to each second element varies the transverse cross-sectional area of the receiving compartment.

In one embodiment of the invention the temperature regulating means is freely supported in the support means.

In another embodiment of the invention the first part of the support means is connected to the temperature regulating means at a first location, and the second part of the support means is connected to the temperature regulating means at a spaced apart second location, so that movement of one of the first and second parts of the support means relative to the other varies the transverse cross-sectional area of the receiving compartment. Preferably, the first part of the support means is connected to the temperature regulating means adjacent to one of the free end edges, and the second part of the support means is connected to the temperature regulating means adjacent to the other of the free end edges of the temperature regulating means. Advantageously, the first location of the temperature regulating means is connected to the base of the housing of the support means and the second location is connected to the annular ring of the support means adjacent the top of the temperature regulating means so that rotation of the annular ring relative to the housing causes the respective end edges to move relative to each other for varying the transverse cross-sectional area of the receiving compartment.

Ideally, the temperature regulating means is releaseably retained in the support means for facilitating removal thereof for locating the temperature regulating means in an appropriate environment for conditioning the temperature conditionable fluid prior to use.

In an alternative embodiment of the invention an urging means is provided for urging the temperature regulating means into engagement with the container located in the receiving compartment. Preferably, the urging means comprises a resilient member mounted on one of the support means and the temperature regulating means and co-operating with the other of the support means and the temperature regulating means for urging the temperature regulating means into engagement with the container. Advantageously, the urging means comprises a ring of resilient material extending round the temperature regulating means. Preferably, a pair of resilient rings are provided spaced apart axially along the central axis.

In one embodiment of the invention the storing means is charged with the temperature conditionable fluid. Preferably, the temperature conditionable fluid is a temperature conditionable liquid. Advantageously, the temperature conditionable liquid is a liquid which is chillable with a freezing point at or below that of water. Ideally, the freezing point of the chillable liquid lies in the range between 0° C. and −20° C.

In one embodiment of the invention the temperature conditionable liquid comprises a mixture of water and any one or more of the following ingredients:

glycerine, saline solution, and propylene glycol.

In another embodiment of the invention alternate storing chambers of the panel member are charged with respective temperature conditionable liquids with different freezing points so that when the temperature conditionable liquid of some of the storing chambers is frozen to a solid phase, the temperature conditionable liquid in the alternate storing chambers is not in a solid phase.

In another embodiment of the invention the temperature conditionable liquid in the alternate storing chambers which is not frozen solid is in a slush ice phase.

The advantages of the invention are many. One important advantage of the device according to the invention is that the device is suitable for regulating the temperature of containers of different sizes, and in particular, different transverse cross-sectional area, and in particular, different diameters. The device is particularly suitable for regulating the temperature of the contents of beverage cans, bottles and the like of different diameters, and in particular, the device is suitable for chilling the contents of beverage cans or bottles, likewise of different diameters. Another advantage of the invention is that as well as being suitable for regulating the temperature of the contents of a beverage or other container to a desired temperature, most of the device according to the invention may be operated for maintaining the temperature of the contents of the container at that desired temperature. This is achieved by altering the transverse cross-sectional area of the receiving compartment of the temperature regulating means so that the temperature regulating means is spaced apart an appropriate distance from the container once the contents of the container have been chilled to the desired temperature. A further advantage of the invention is that it is particularly suitable for chilling the contents of wine, hock, champagne and water bottles.

Figure 2:
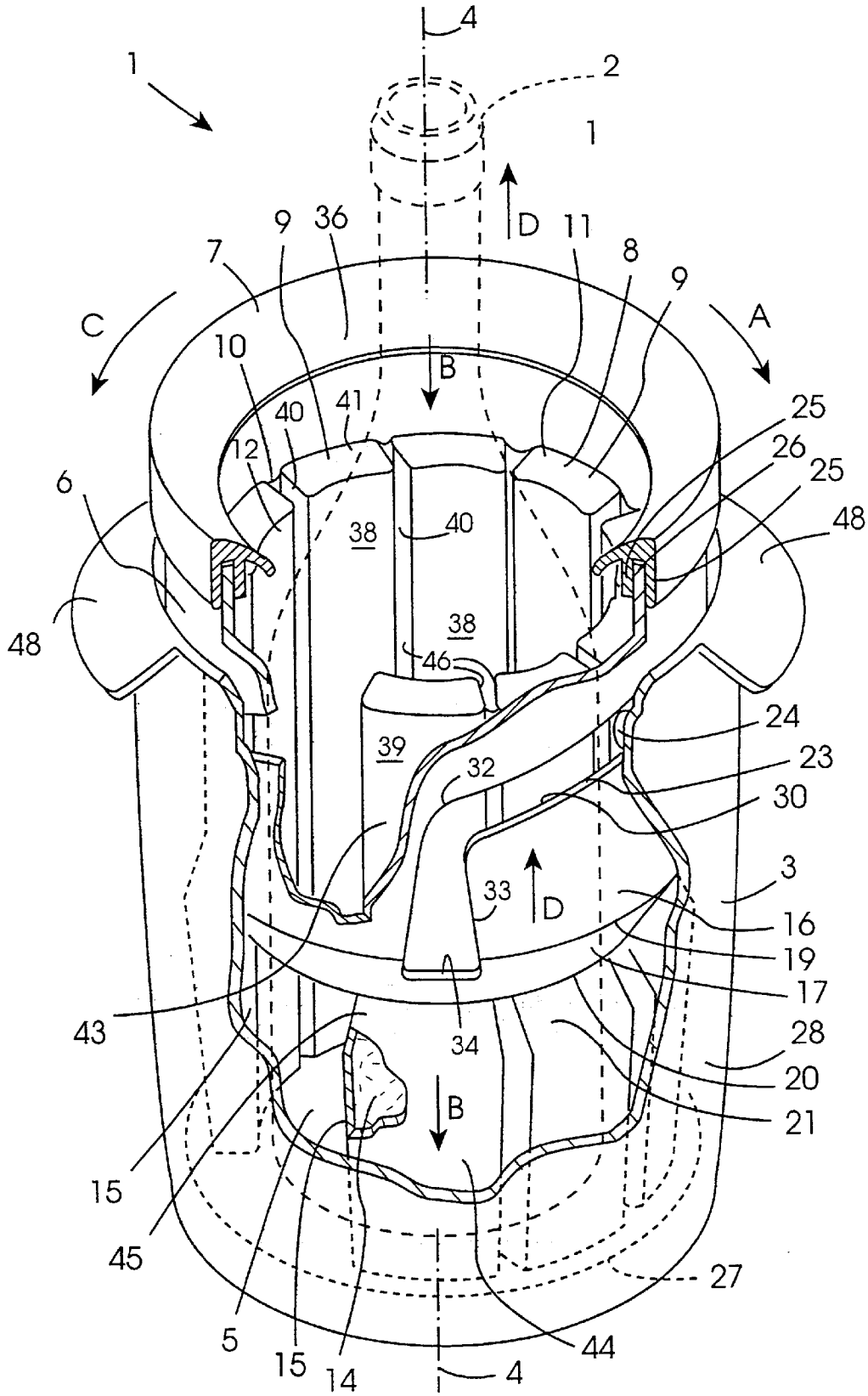
Figure 3:
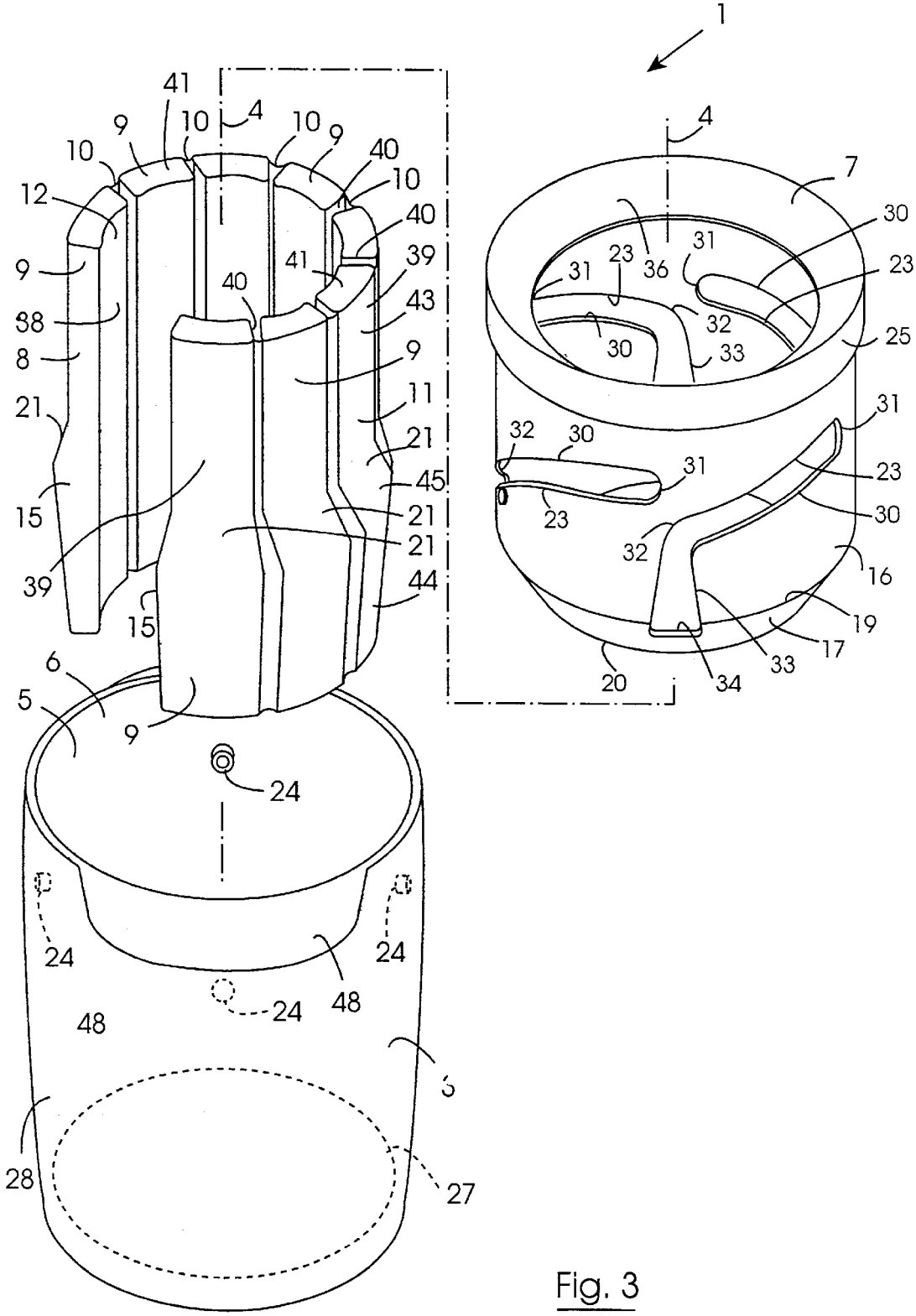
Figure 4:
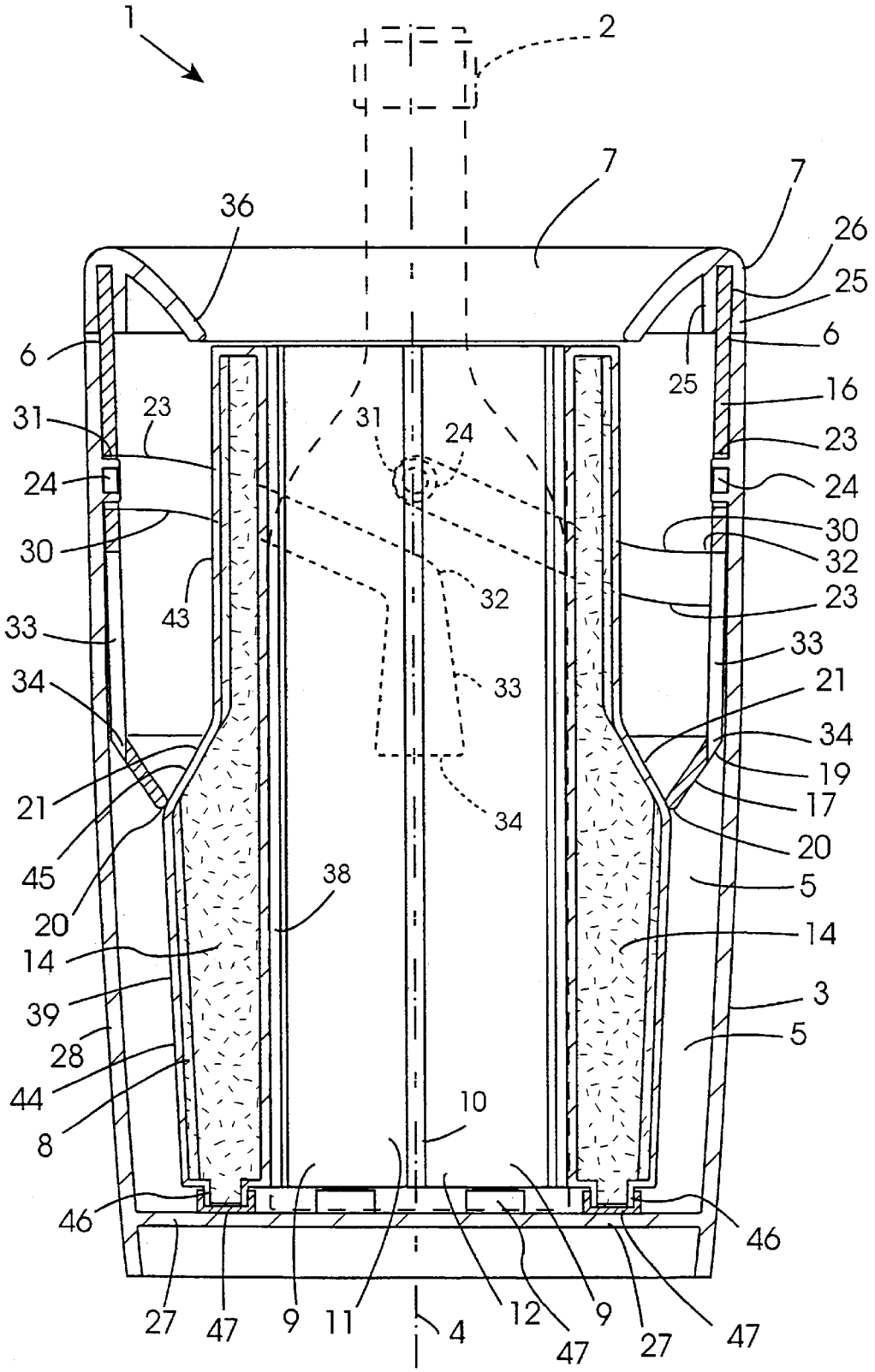
Figure 5:
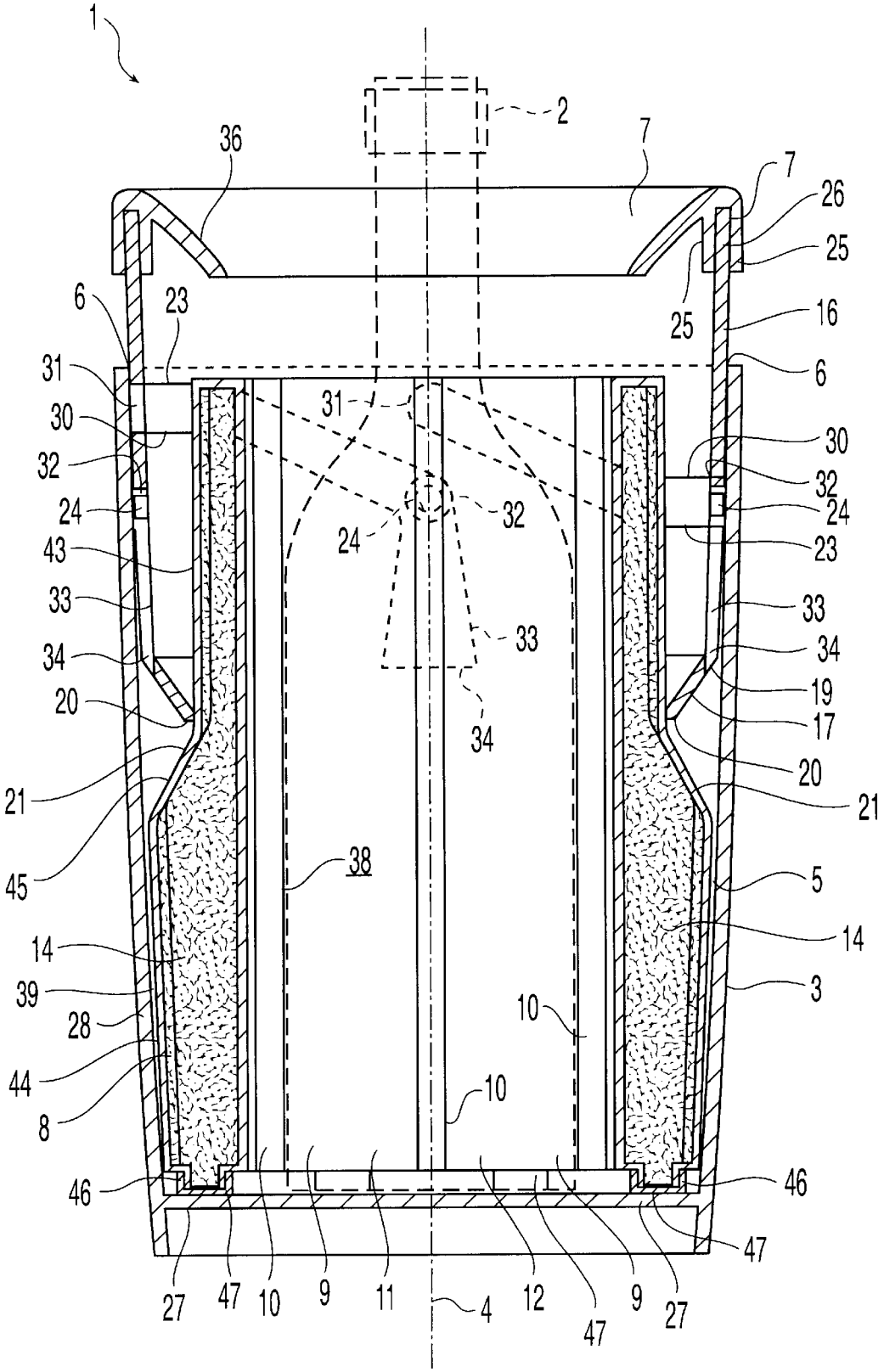
Figure 6:
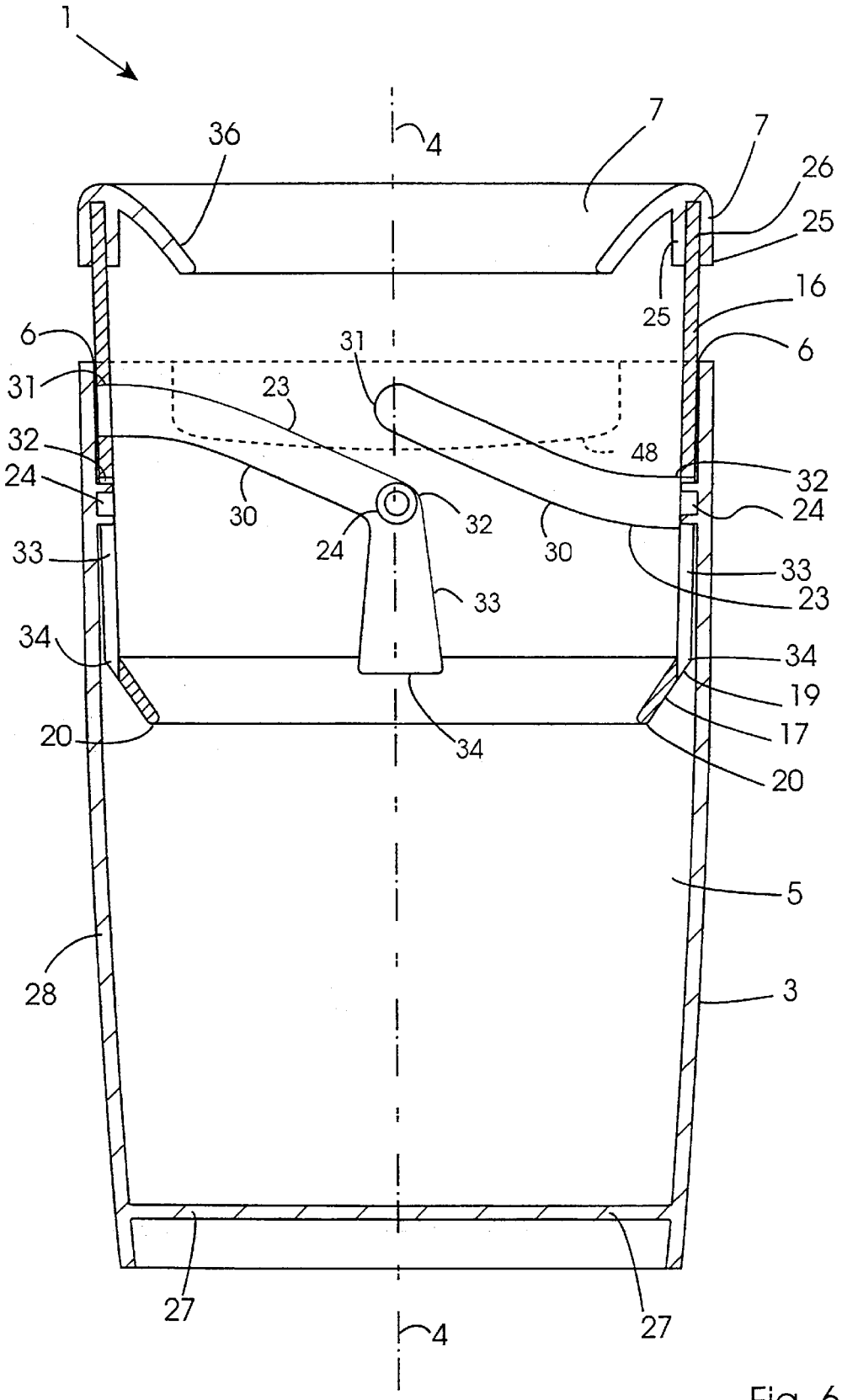
Figure 7:
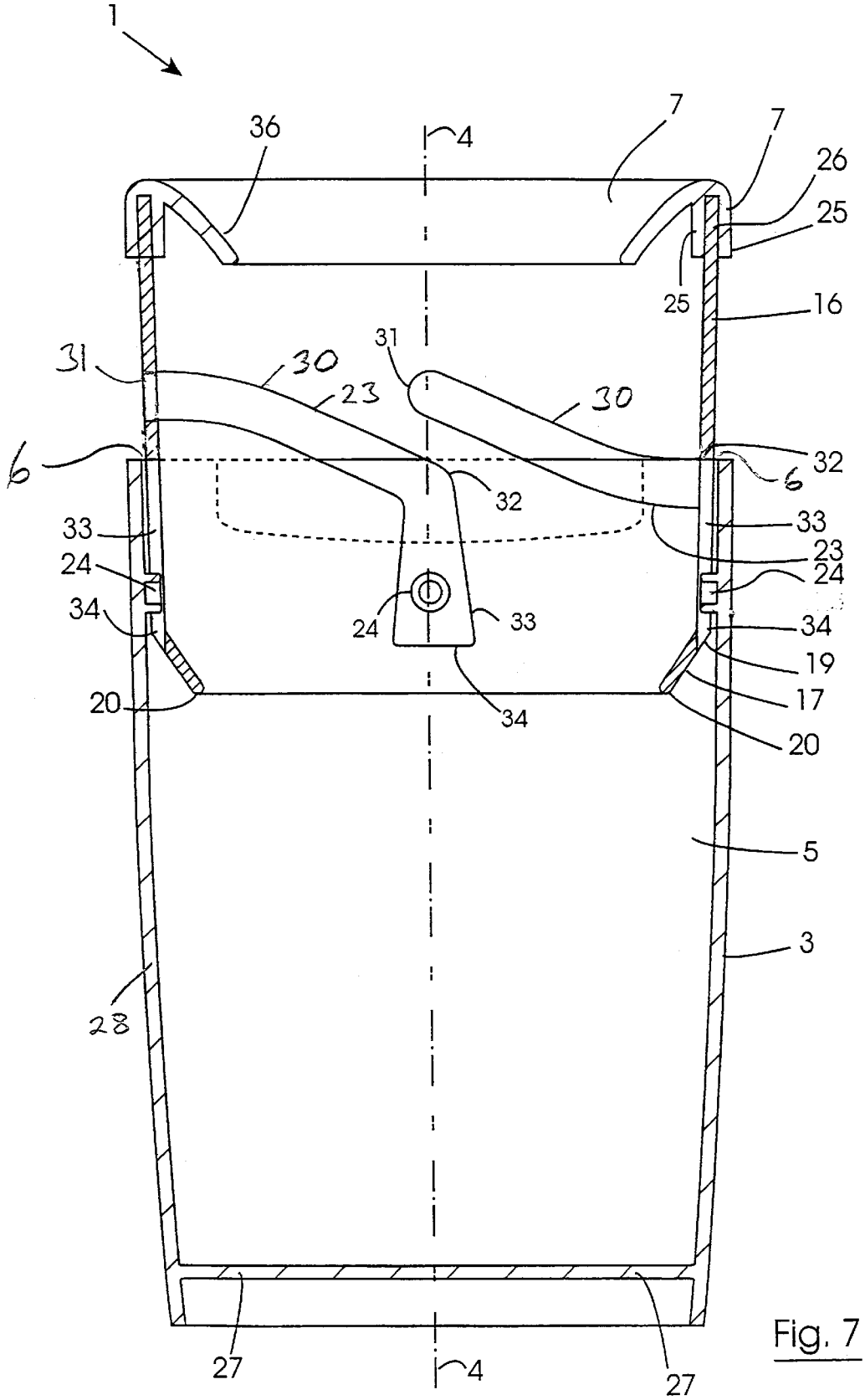
Figure 12:
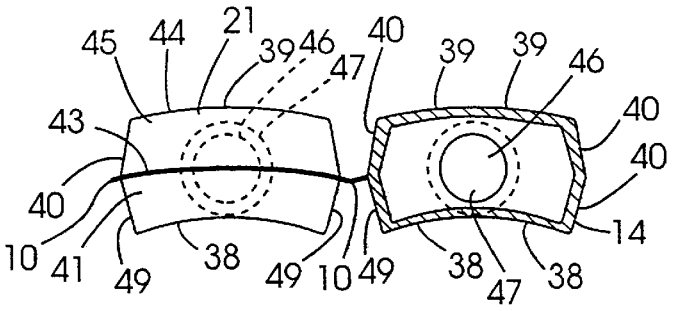
Figure 8:
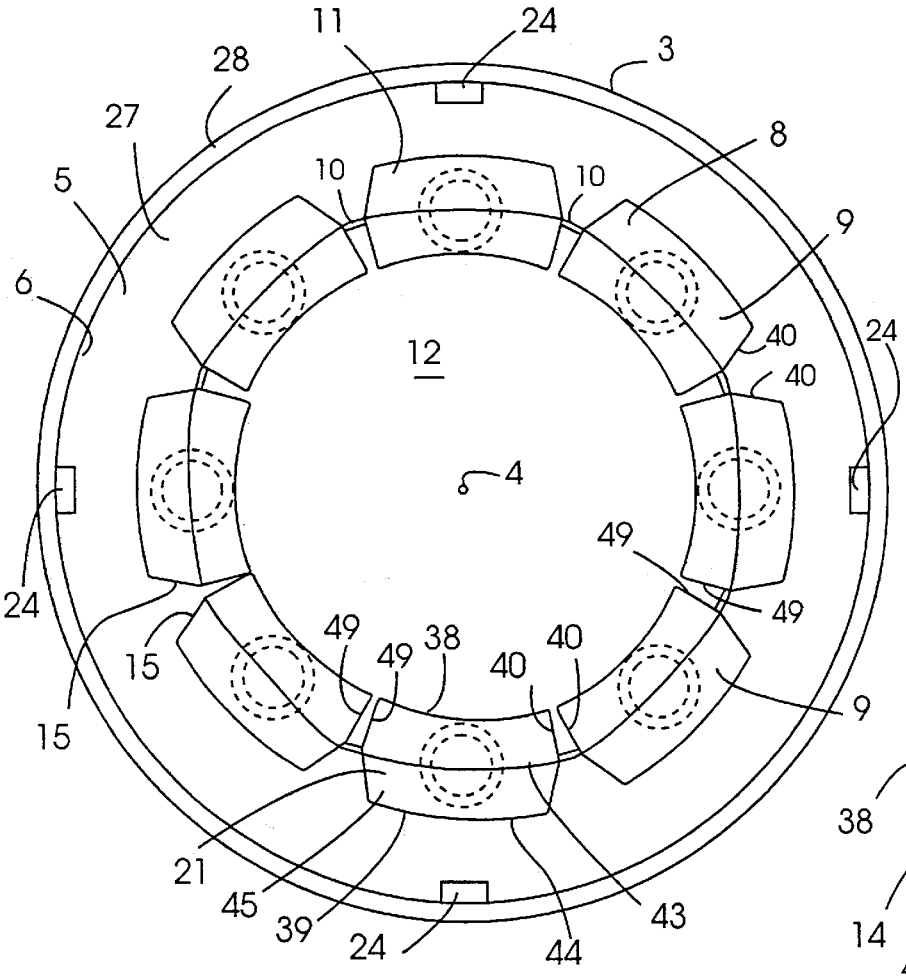
Figure 11:
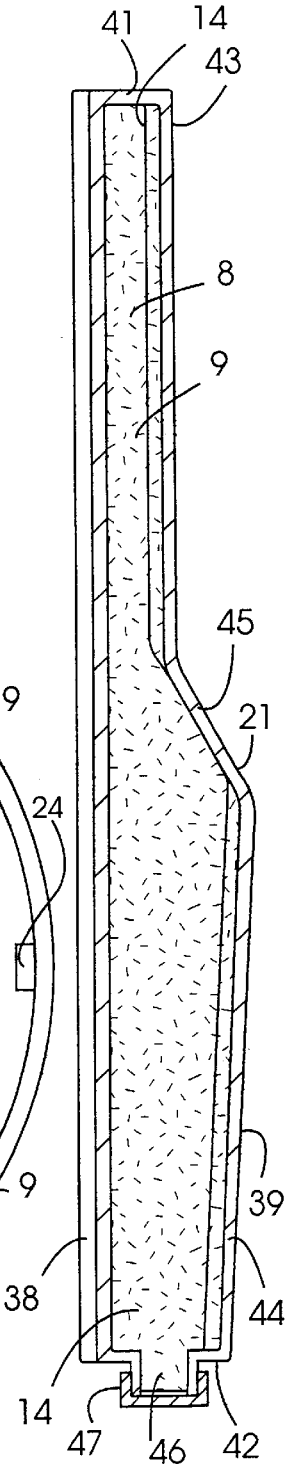
Figure 9:
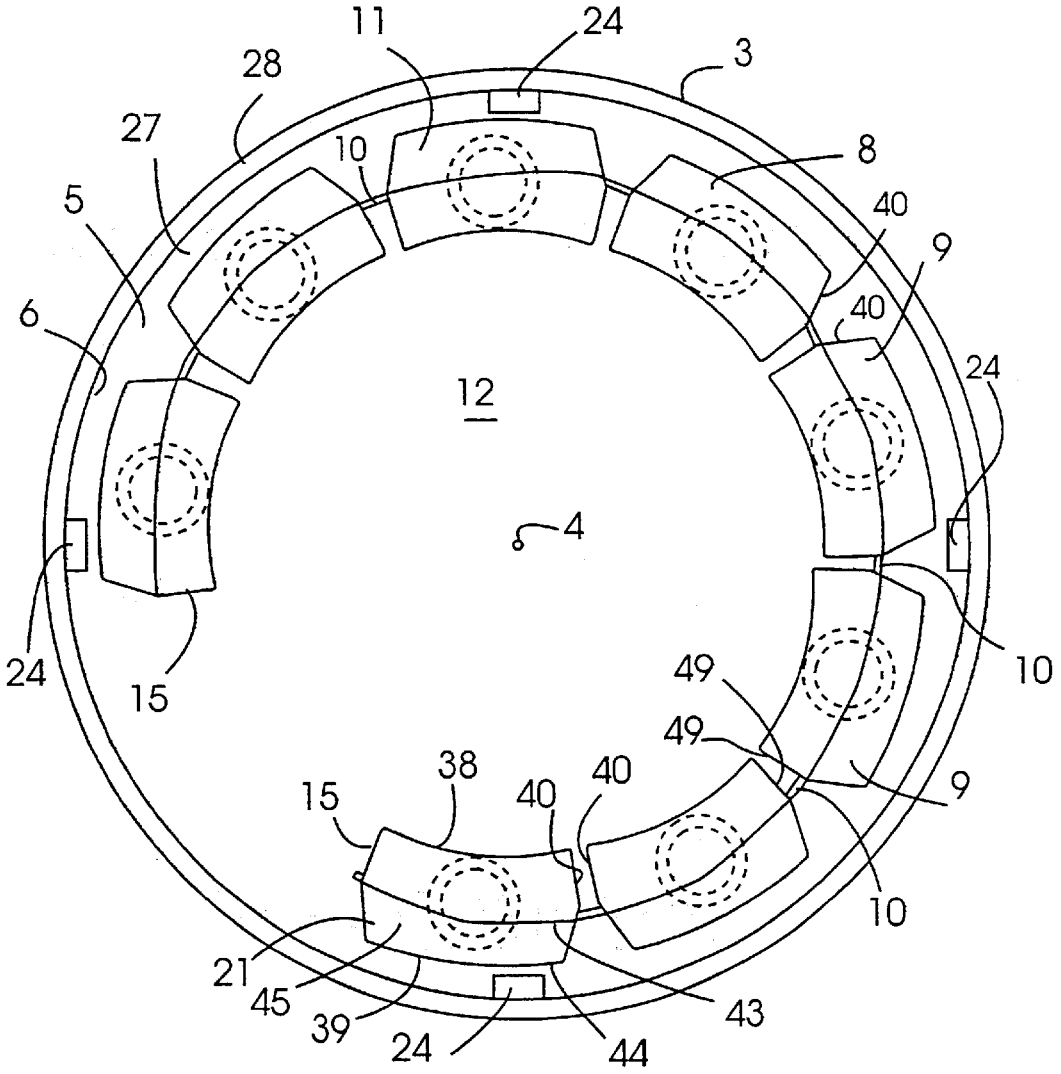
Figure 10:
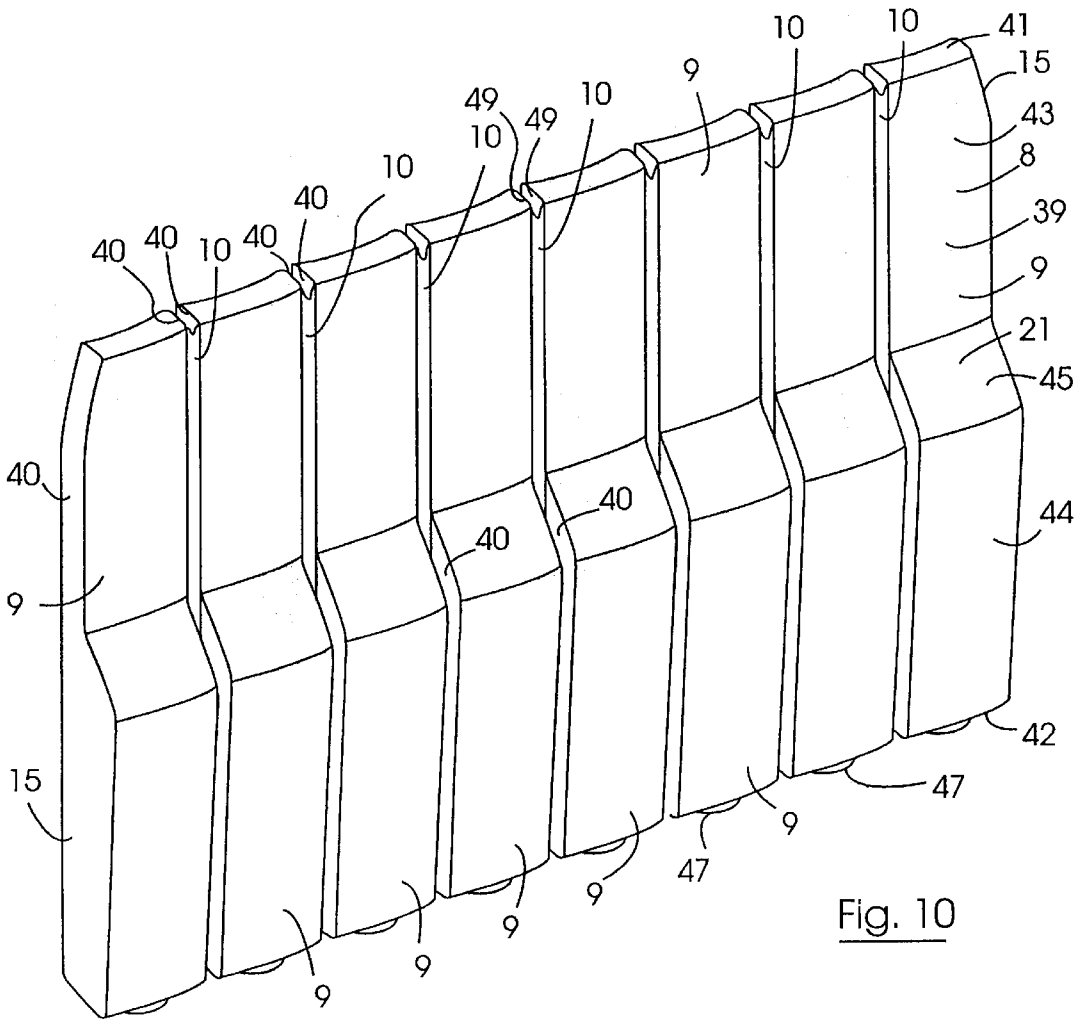
Figure 13:
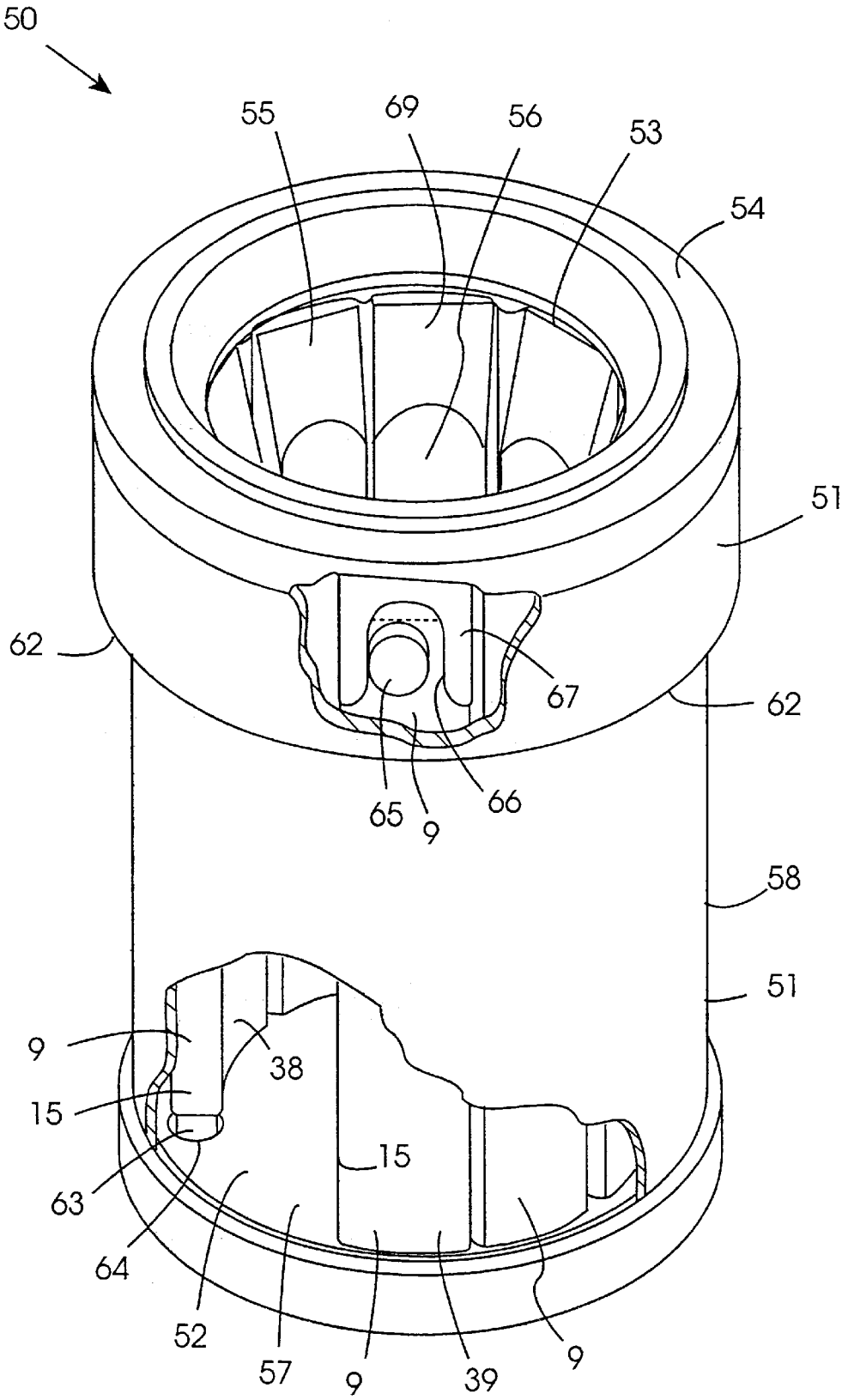
Figures 14, 19:
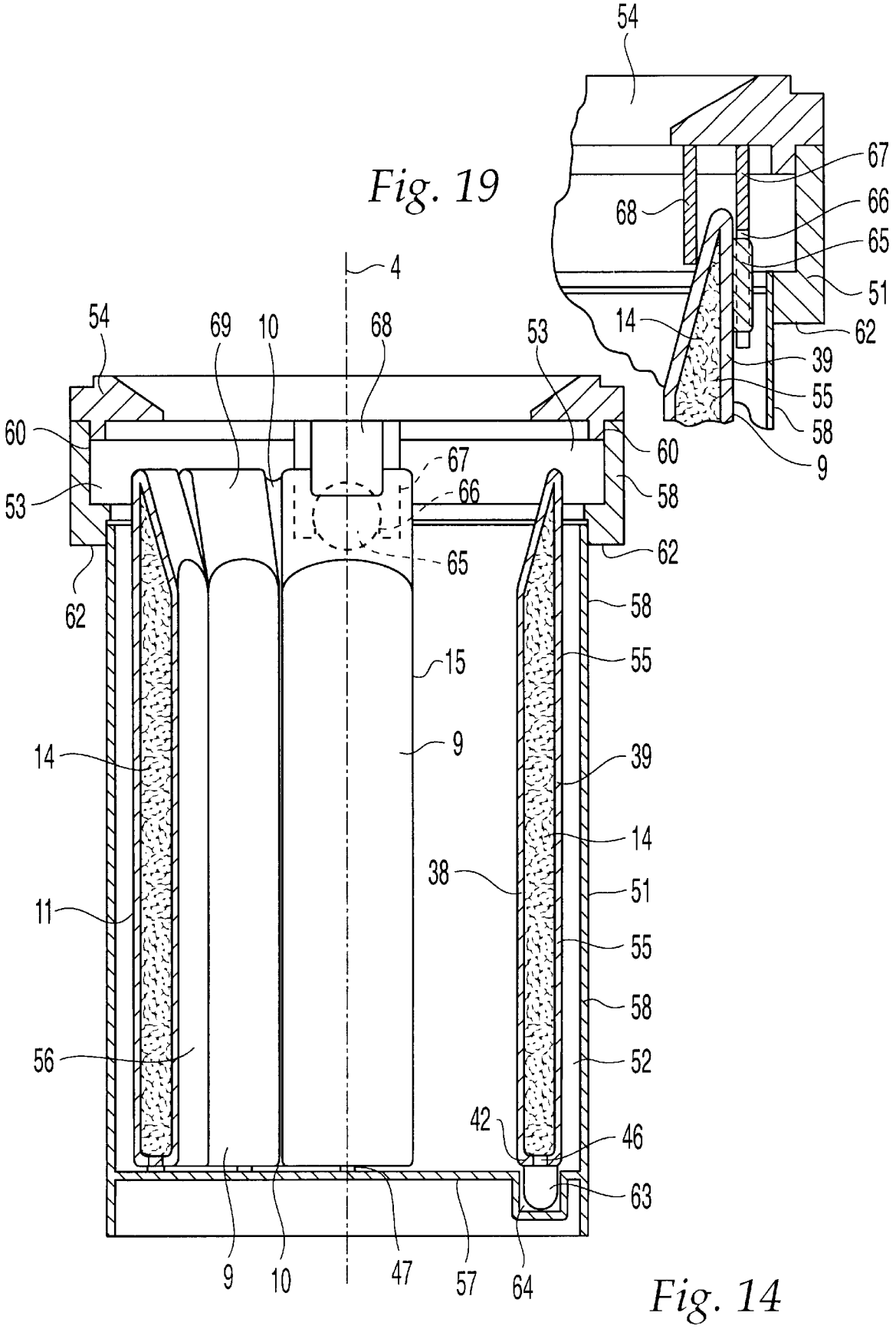
Figure 15:
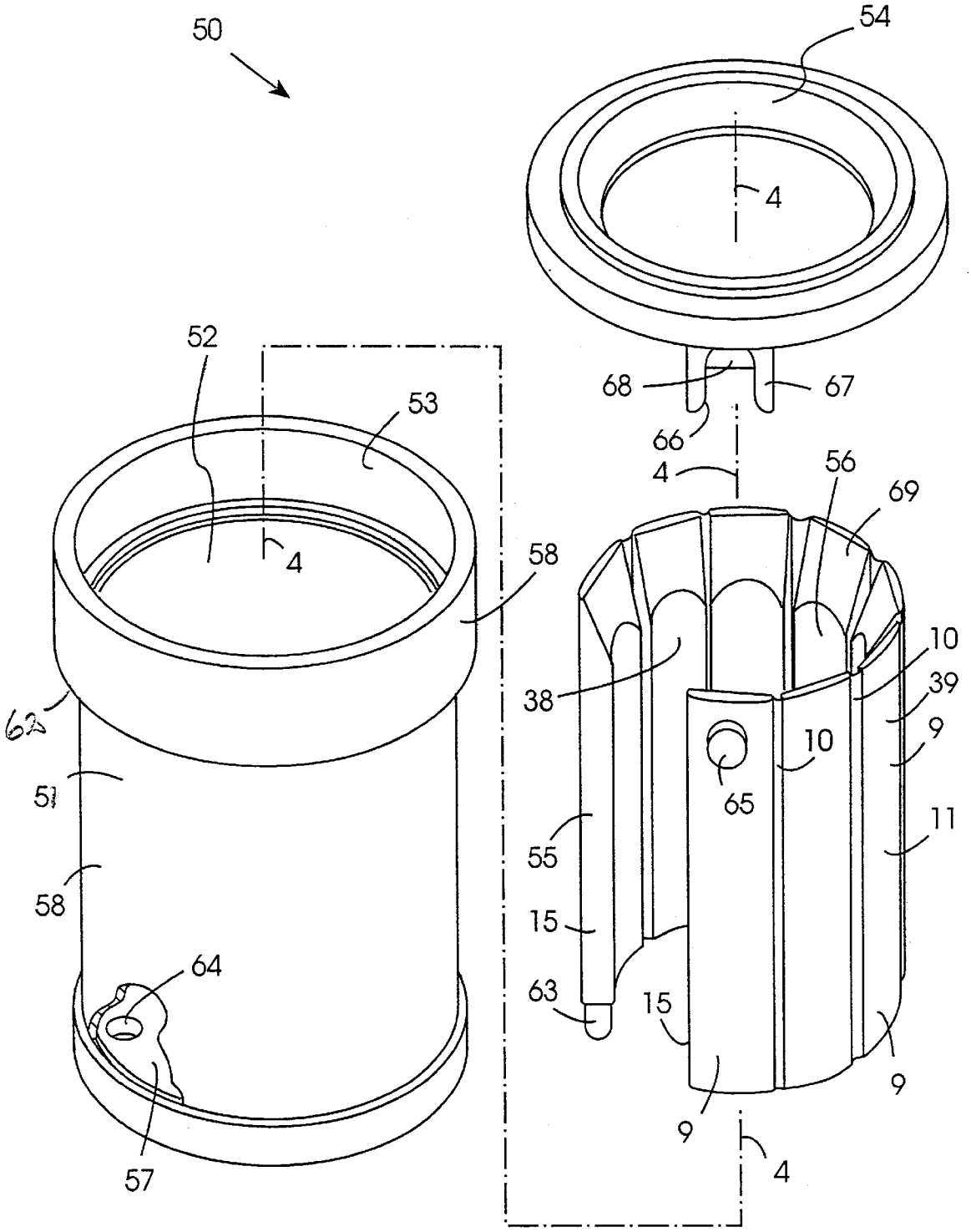
Figure 18:
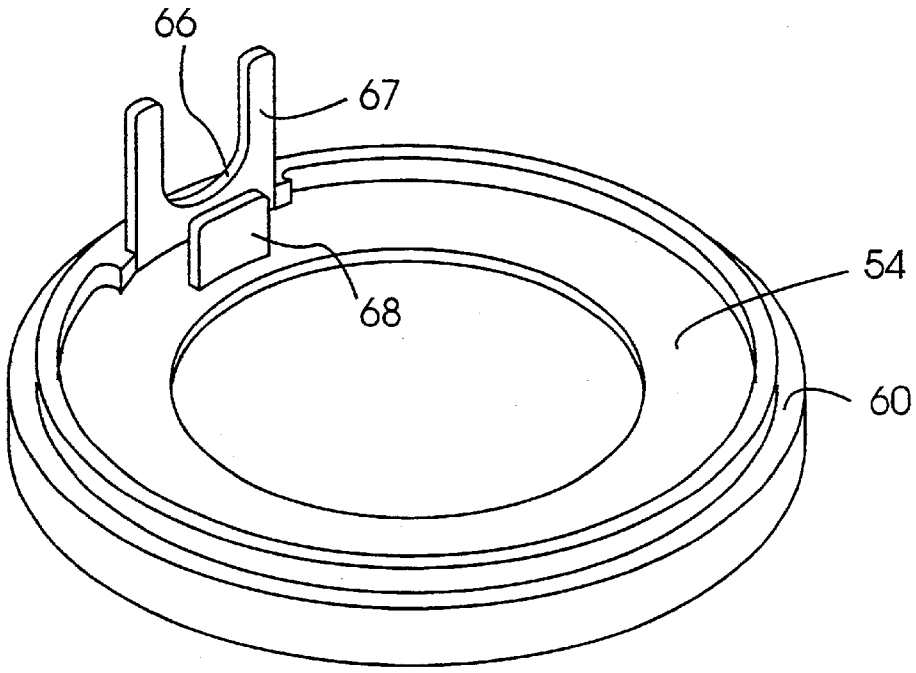
Figure 16:
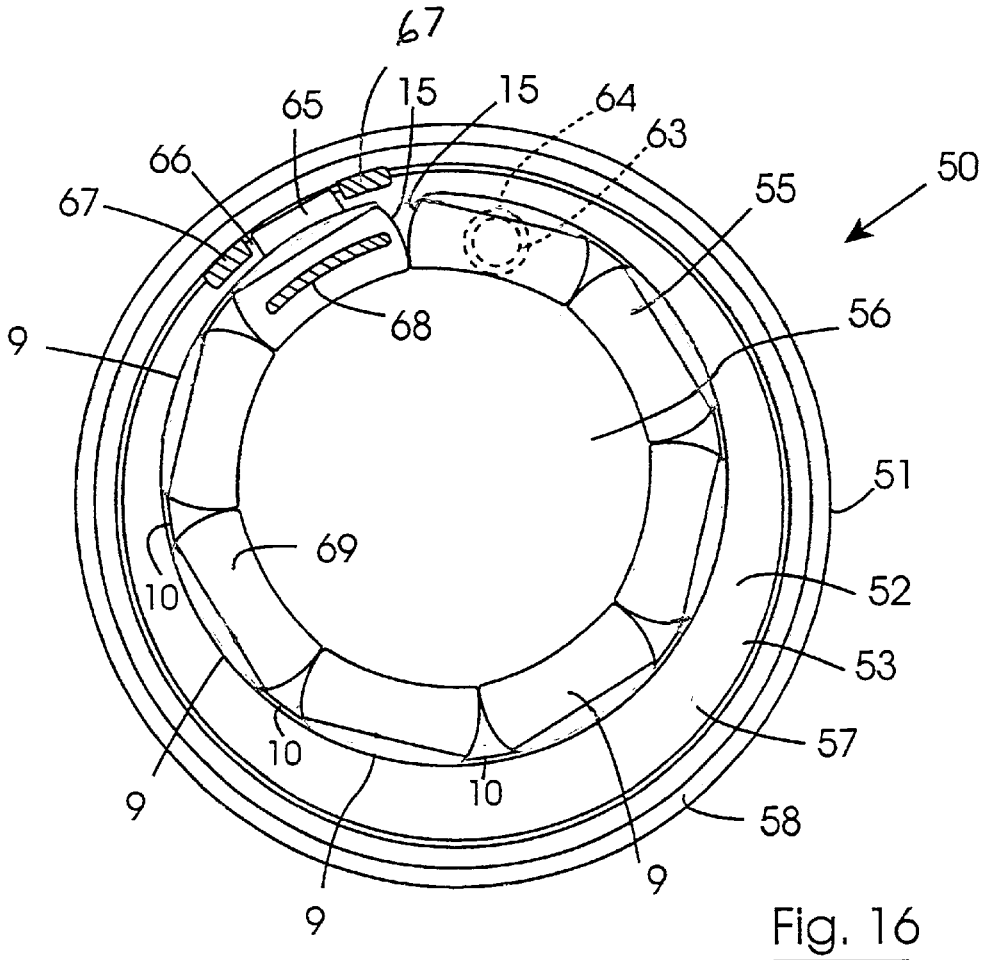
Figure 17:
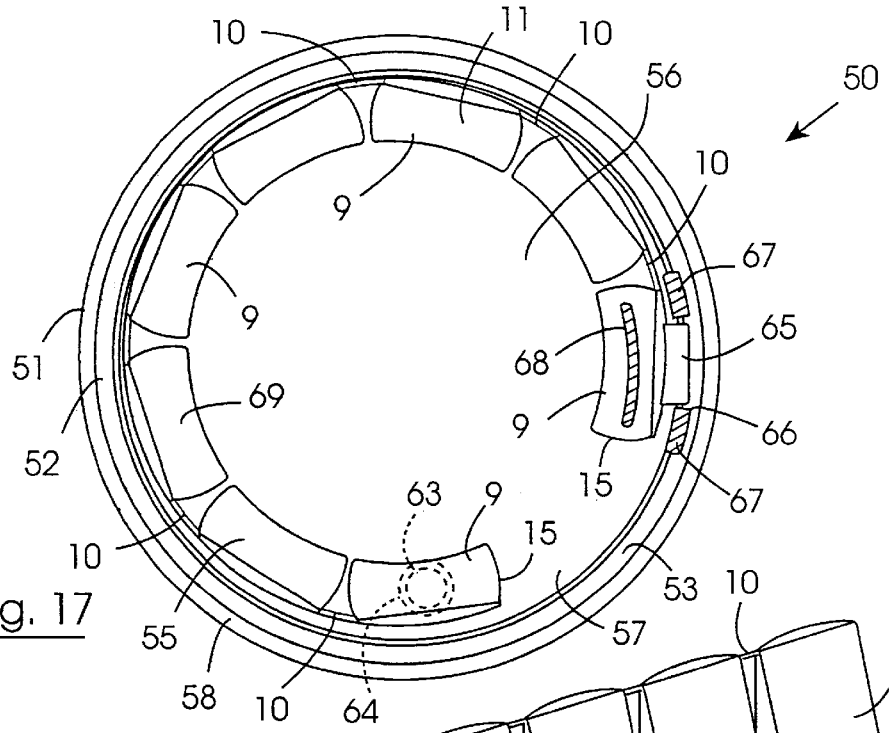
Figure 20:
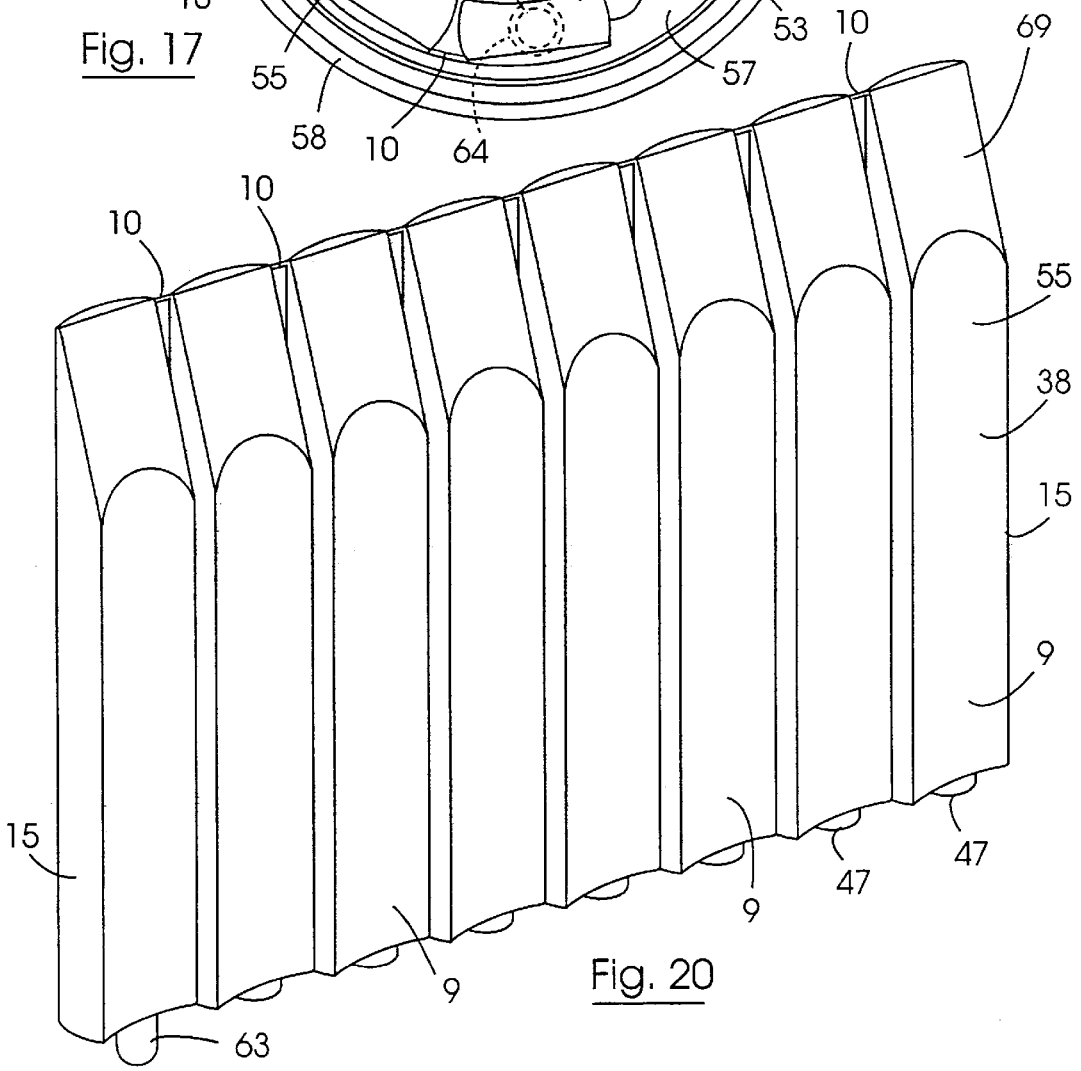
Figure 22:
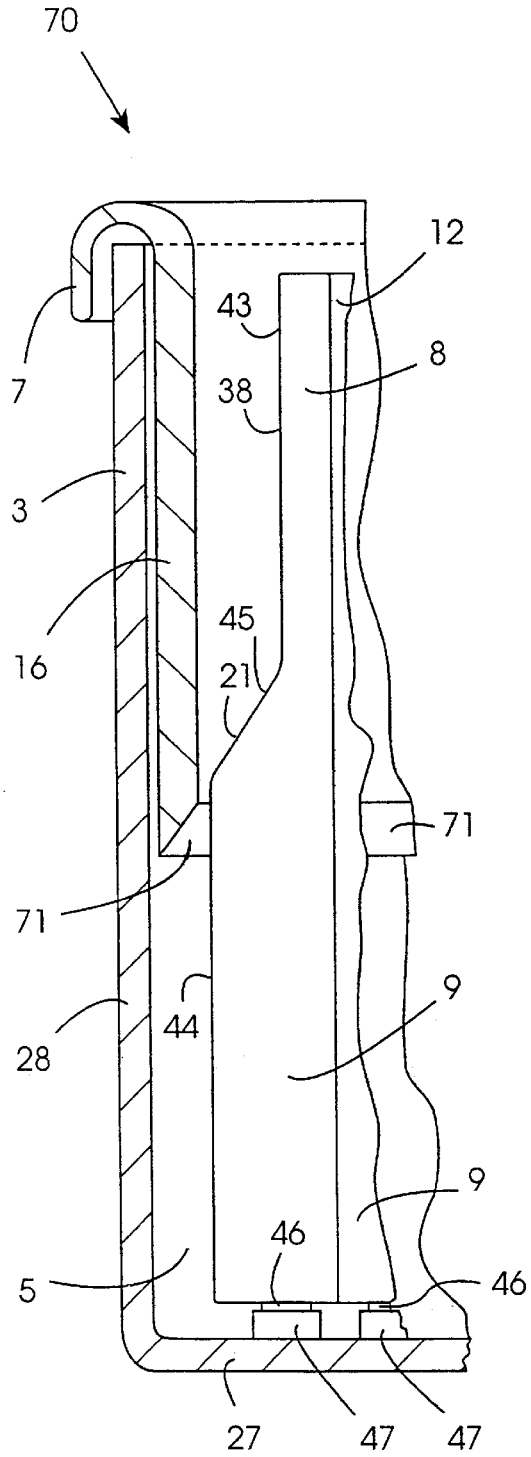
Figure 21:
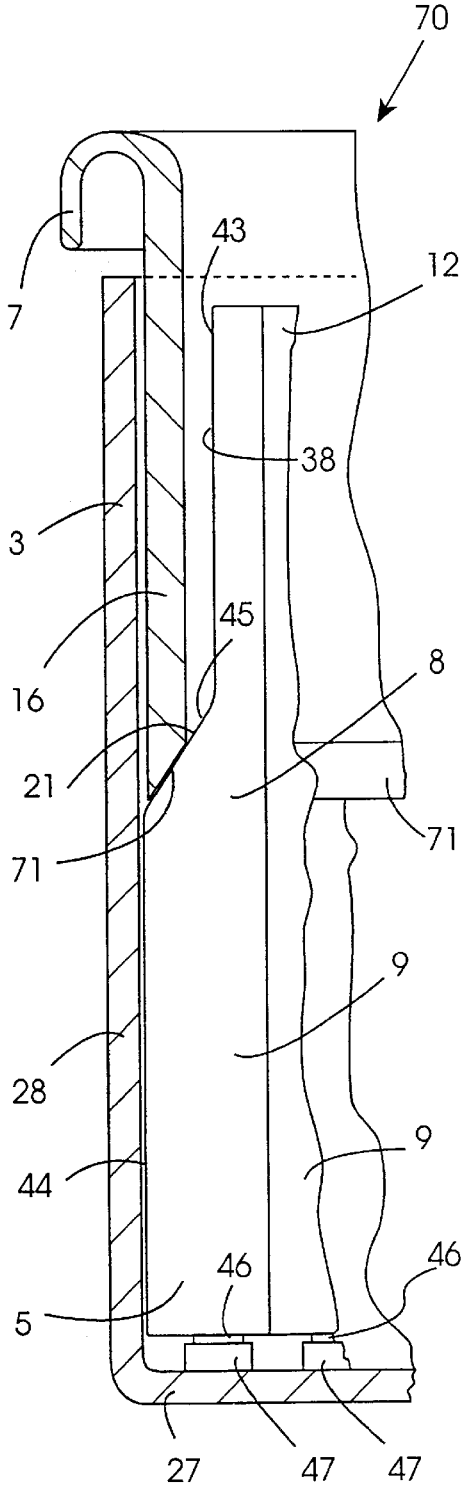
Figure 23:
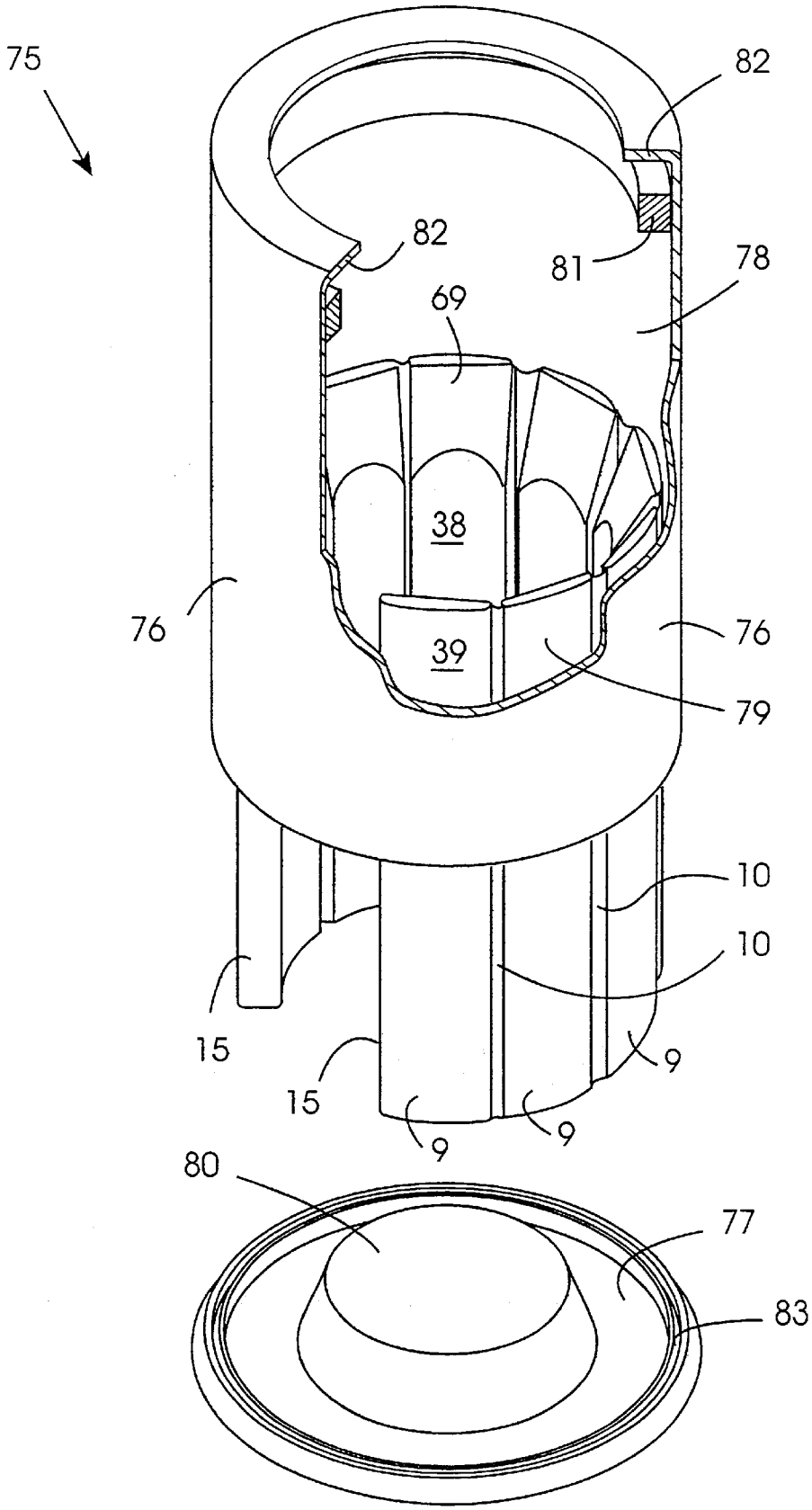
Figure 25:
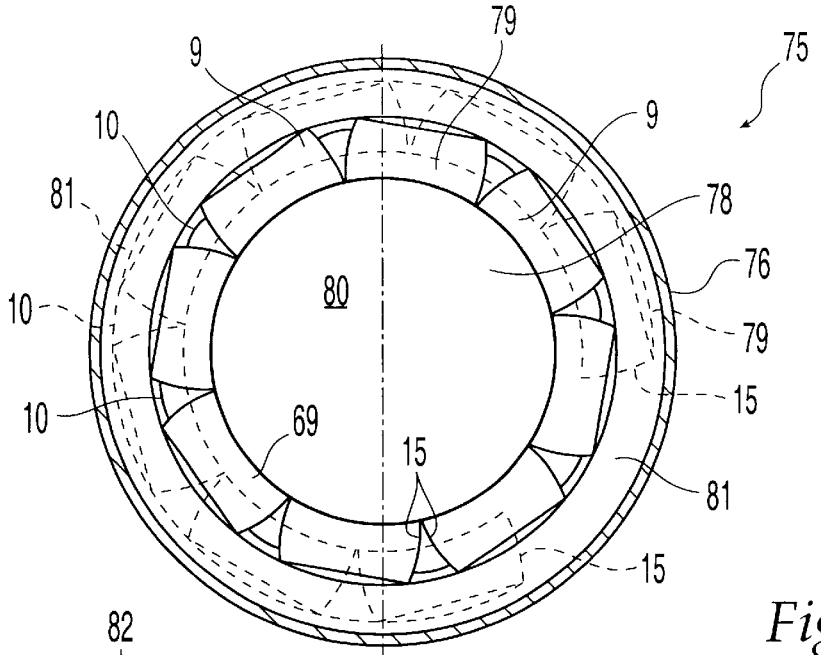
Figure 24:
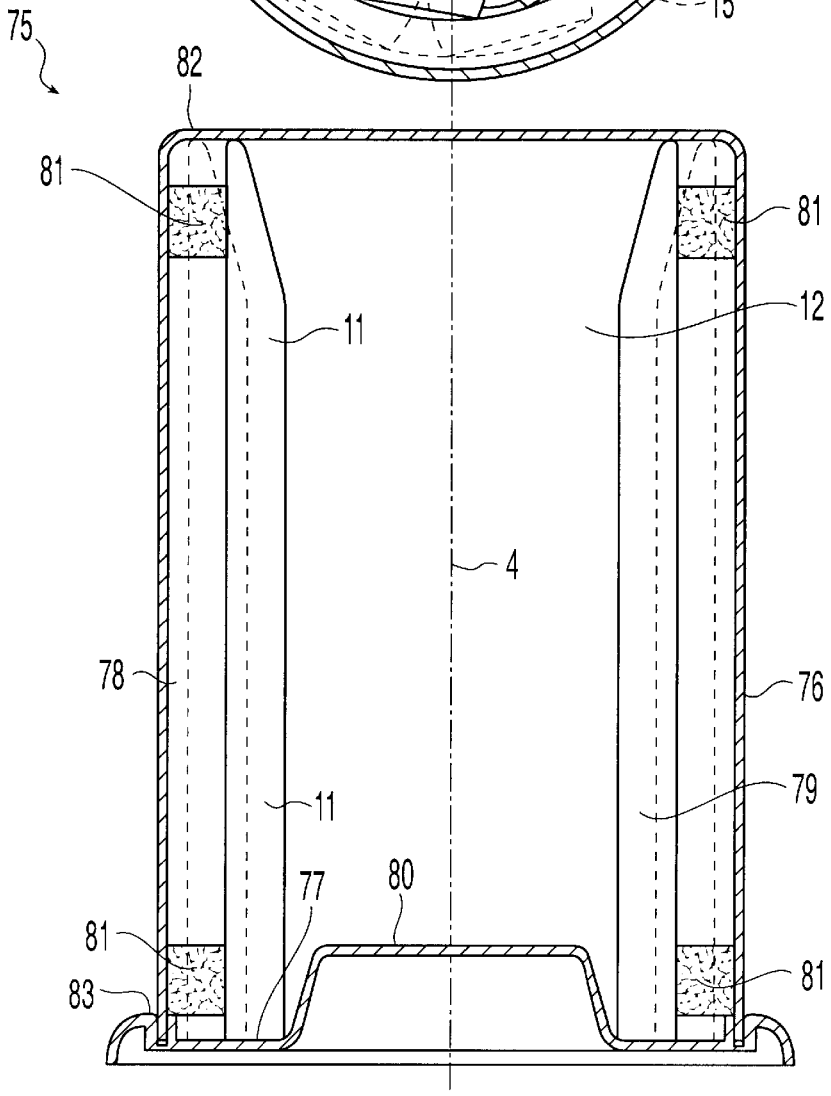
Figure 26:
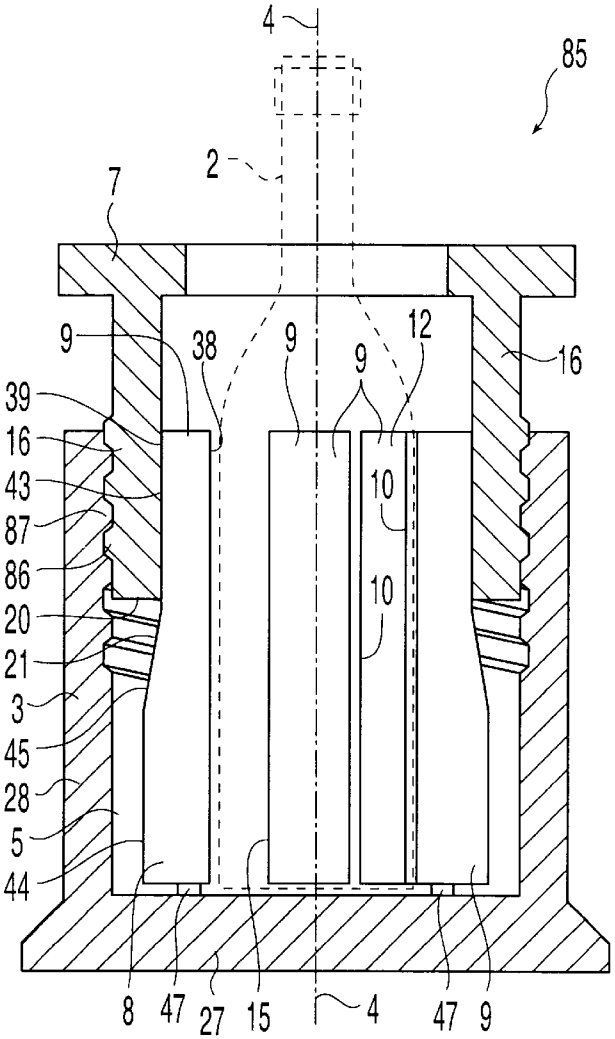
Figure 27:
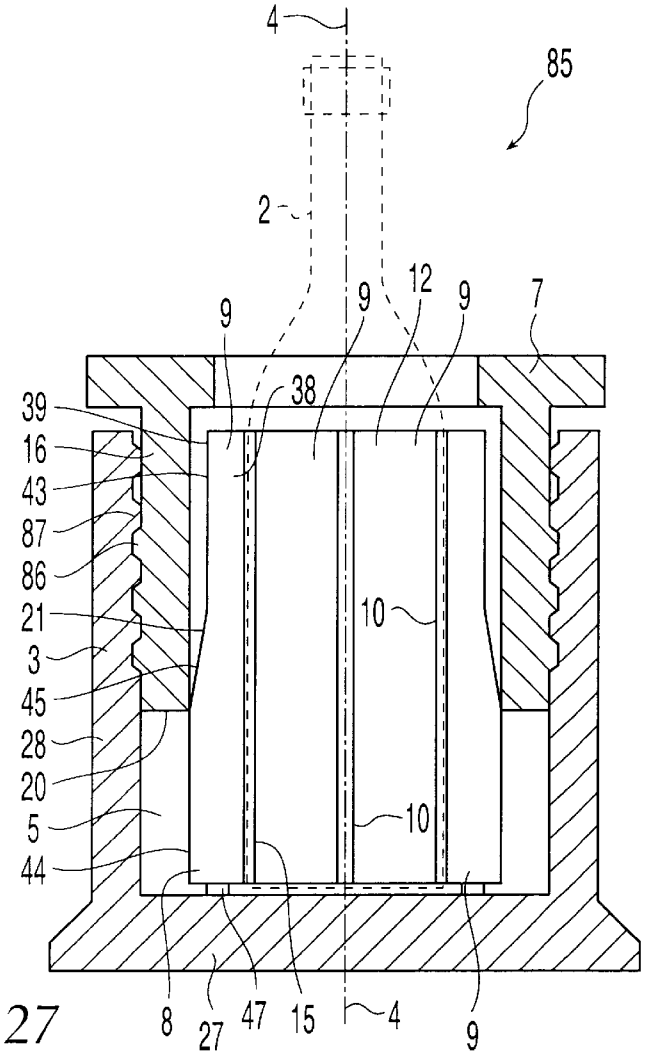

The invention will be more clearly understood from the following description of some preferred embodiments thereof which are given by way of example only, with reference to the accompanying drawings, in which:

FIG. 1 is a perspective view of a device for regulating the temperature of the contents of a container, namely, a cooling device according to the invention for chilling a wine bottle, FIG. 2 is a cut-away perspective view of the device of FIG. 1, FIG. 3 is an exploded perspective view of the device of FIG. 1, FIG. 4 is a sectional elevational view of the device of FIG. 1, FIG. 5 is a sectional elevational view of the device of FIG. 1 illustrating a portion of the device in a different position to that of FIG. 4, FIG. 6, is a sectional elevational view of the device of FIG. 1 with a portion of the device of FIG. 1 removed, FIG. 7 is a sectional elevational view similar to FIG. 6 of the device of FIG. 1 illustrating a portion of the device in a different position to that of FIG. 6, FIG. 8 is a sectional plan view of the device of FIG. 1, FIG. 9 is a sectional plan view similar to that of FIG. 8 of the device of FIG. 1 illustrating a portion of the device in a different position to that of FIG. 8, FIG. 10 is a perspective view of a portion of the device of FIG. 1, FIG. 11 is a sectional elevational view of the portion of the device illustrated in FIG. 10, FIG. 12 is a partly sectional plan view of the portion of the device illustrated in FIG. 10, FIG. 13 is a partly cut-away perspective view of a cooling device according to another embodiment of the invention, FIG. 14 is a sectional elevational view of the device of FIG. 13, FIG. 15 is an exploded perspective view of the device of FIG. 13, FIG. 16 is a sectional plan view of the device of FIG. 13, FIG. 17 is a sectional plan view similar to FIG. 16 of the device of FIG. 13 illustrating a portion of the device in a different position to that of FIG. 16, FIG. 18 is an underneath perspective view of a portion of the device of FIG. 13, FIG. 19 is an enlarged sectional view of a detail of the device of FIG. 13, FIG. 20 is a perspective view of a portion of the device of FIG. 13, FIG. 21 is a sectional elevational view of a portion of a cooling device according to another embodiment of the invention, FIG. 22 is a sectional elevational view similar to FIG. 21 of the portion of the device of FIG. 21 illustrating two parts of the device in different positions to that of FIG. 21, FIG. 23 is a partly exploded perspective view of a cooling device according to another embodiment of the invention, FIG. 24 is a sectional elevational view of the device of FIG. 23, FIG. 25 is a sectional plan view of the device of FIG. 23, FIG. 26 is a sectional elevational view of a cooling device according to another embodiment of the invention, and FIG. 27 is a sectional elevational view similar to FIG. 26 of the device of FIG. 26 with a part of the cooling device in a different position to that of FIG. 26.

Referring to the drawings, and initially to FIGS. 1 to 12, there is illustrated a device according to the invention for regulating the temperature of the contents of a beverage container, in this case, the device is a cooling device which is indicated generally by the reference numeral 1 for cooling the contents of a wine bottle to a desired chilled temperature and/or for maintaining the temperature of the contents of the wine bottle at a desired chill temperature. For convenience the wine bottle which does not form part of the invention is illustrated in broken lines and is indicated by the reference numeral 2. The cooling device 1 comprises a support means, which in this embodiment of the invention is a two-part support means comprising a first part, namely, an outer housing 3 of substantially cylindrical shape which defines a longitudinally extending central geometric axis 4, a main hollow interior region 5 and an open mouth 6 to the hollow interior region 5. A second part of the support means, namely, an annular ring 7 is rotatably carried in the housing 3 adjacent to the open mouth 6 and is co-axial with the central axis 4.

A temperature regulating means comprising a panel member 8 is located within the hollow interior region 5 of the housing 3 for chilling and maintaining the temperature of wine in the bottle 2 at the desired chilled temperature. The panel member 8 comprises a plurality of longitudinally extending panel segments 9 which are connected by connecting means, namely, resilient plastics hinges 10, and is bent to form a sleeve 11 against the resilient urging action of the hinges 10. The sleeve 11 defines a receiving compartment 12 in the form of a longitudinally extending bore of circular transverse cross-section for receiving the bottle 2. The bore formed by the receiving compartment 12 defines a central geometric axis which coincides with the central axis 4 of the housing 3. The panel segments 9 each define a storing means, namely, discrete storing chambers 14 for storing a temperature conditionable liquid, in this embodiment of the invention a mixture of water and glycerine which can be chilled or frozen to an appropriate temperature for chilling the contents of the bottle 2.

The panel member 8 when lying flat, see FIG. 10, defines a pair of longitudinally extending opposite end edges 15 which when the panel member 8 is bent to form the sleeve 11 in the hollow interior region 5, are relatively close to each other and extend parallel to the central axis 4. The transverse cross-sectional area of the receiving compartment 12 is varied as the end edges 15 are moved towards or away from each other for accommodating bottles 2 of different diameters. Providing the receiving compartment with variable transverse cross-sectional area also facilitates operation of the device 1 in two modes, namely, a first mode for altering the temperature of the wine in the bottle 2, in other words, a chilling mode for chilling the wine to the desired chilled temperature, and a second mode for maintaining the temperature of the wine in the bottle 2 at a desired chill temperature, after the wine has been chilled to the desired temperature. In the first mode the transverse cross-sectional area of the receiving compartment 12 is adjusted so that the panel segments 9 of the panel member 8 tightly abut the bottle 2, and in the second mode, the transverse cross-sectional area of the receiving compartment 12 is adjusted so that the panel segments 9 are appropriately spaced apart from the bottle 2.

A carrier means, namely, a carrier sleeve 16 extends downwardly from the annular ring 7 into the hollow interior region 5 between the panel member 8 and the housing 3, and is rotatable and axially slideable in the housing 3. A first element, namely, an inwardly tapering ring 17 extends from a lower free end 19 of the carrier sleeve 16, and terminates at its free end in a circular bearing rim 20 which forms the first element. The bearing rim 20 bears on and co-operates with second elements which are formed by outwardly downwardly extending wedge-shaped portions 21 of the panel segments 9 for urging the panel segments 9 inwardly and outwardly relative to the central axis 4 for varying the transverse cross-sectional area of the receiving compartment 12.

A constraining means provided by a cam drive means constrains the annular ring 7 and the carrier sleeve 16 and in turn the bearing rim 20 to move axially in the hollow interior region 5 when the annular ring 7 and the carrier sleeve 16 are rotated for varying the transverse cross-sectional area of the receiving compartment 12. The cam drive means comprises a camming means, namely, four cam profiles 23 on the carrier sleeve 16 which co-operate with corresponding cam follower means, namely, four cam followers 24, which extend inwardly into the hollow interior region 5 from the housing 3 for constraining the bearing rim 20 to move axially as the annular ring 7 is rotated relative to the housing 3.

Returning now to the housing 3 and the annular ring 7 in more detail, the housing 3 is of injection moulded plastics material, and comprises a base 27 and an upwardly extending side wall 28 which is of substantially cylindrical shape but is slightly tapered downwardly inwardly towards the base 27. The side wall 28 defines the central axis 4, and the side wall 28 with the base 27 defines the hollow interior region 5. The annular ring 7 is of injection moulded plastics material, and comprises a pair of spaced apart ring members 25 extend downwardly from the annular ring 7, which define therebetween an annular groove 26 for receiving and rigidly securing the carrier sleeve 16 to the annular ring 7.

The carrier sleeve 16 is also of injection moulded plastics material and is of such outer diameter as to provide a clearance fit with the inner surface of the housing 3 for facilitating rotational and axial movement of the carrier sleeve 16 within the housing 3. Four cam slots 30 which define the cam profiles 23 are formed at equi-spaced intervals of 90° around the carrier sleeve 16. The cam slots 30 incline downwardly from an upper end 31 to a lower end 32. Entry slots 33 extend downwardly from the cam slots 30 at the lower ends 32 for accommodating the cam followers 24 into and out of the respective cam slots 30 for facilitating insertion and removal of the carrier sleeve 16 into and out of the housing 3 for permitting removal of the panel member 8 for freezing or chilling thereof. The entry slots 33 diverge downwardly, outwardly for facilitating ease of entry of the cam followers 24 into the entry slots 33 on insertion of the carrier sleeve 16 into the housing 3. The entry slots 33 terminate in the inwardly tapering ring 17 at 34 at respective positions which provides adequate clearance for the cam followers 24 past the inwardly tapering ring 17 into the entry slots 33. The cam followers 24 are secured to the inner surface of the housing 3 at equi-spaced intervals of 90° around the housing 3.

By rotating the annular ring 7 through 90° in the direction of the arrow A, the cam followers 24 acting on the cam profiles 23 urge the carrier sleeve 16 axially downwardly into the hollow interior region 5 in the direction of the arrow B. for in turn, urging the bearing rim 20 to move downwardly over the wedge-shaped portions 21 of the panel member 8 for in turn, reducing the transverse cross-sectional area of the receiving compartment 12. Rotation of the annular ring 7 in the reverse direction, namely, in the direction of the arrow C urges the carrier sleeve 16 axially upwardly in the direction of the arrow D within the hollow interior region 5 so that the bearing rim 20 moves upwardly over the wedge-shaped portions 21 for permitting the panel segments 9 to move outwardly under resilient action of the plastics hinges 10 for increasing the transverse cross-sectional area of the receiving compartment 12.

An annular lip 36 extends inwardly downwardly from the annular ring 7 for retaining the panel member 8 in the hollow interior region 5.

Returning now to the panel member 8, each panel segment 9 is formed by an inner wall 38 and an outer wall 39 joined by end walls 40 and top and bottom walls 41 and 42, respectively, which together form the storing chamber 14 of each panel segment 9. The inner walls form an inner face which defines the receiving compartment 12 when the panel member is formed into the sleeve 11. The outer walls 39 are formed by an upper portion 43 and a lower portion 44 which are joined by an outwardly downwardly inclined intermediate portion 45 which forms the wedge-shaped portion 21. When the panel member 8 is formed into the sleeve 11 to form the circular receiving compartment 12 the intermediate portions 45 define a fusto-conical portion which co-operates with the bearing rim 20 of the inwardly tapering ring 17 for varying the diameter of the receiving compartment 12 as the rim 20 is moved axially over the wedge-shaped intermediate portions 45. The upper portions 43 of the outer wall 39 define an upper cylindrical portion while the lower portions 44 of the outer wall 39 define a lower substantially cylindrical portion of diameter greater than the diameter of the upper cylindrical portion.

The inner walls 38 of the panel segments 9 are slightly arcuate for further increasing surface contact between the panel segment 9 and the bottle 2. The outer wall 39, including the intermediate portion 45 are correspondingly arcuate in plan view, for accommodating sliding of the bearing rim 20 over the upper portions 43 the intermediate portions 45. Portions 49 of the end walls 40 between the plastics hinges 10 and the inner walls 38 of the panel segments 9 are chamfered for facilitating bending of the panel member 8 to form the sleeve 11, so that when the diameter of the receiving compartment 12 is at a minimum with the respective end edges 15 touching each other, the chamfered portions substantially abut each other for maximising heat transfer between the panel member 8 and the bottle 2.

The panel member 8 is formed of plastics material as a single integral unit by blow moulding, and the plastic hinges 10 which extend the length of the panel segments 9 are integrally formed during the blow moulding process. Typically, the panel member 8 is formed as a flat, see FIG. 10, which can be subsequently bent to form the sleeve 11, see FIG. 8. Typically, when chilling or freezing the temperature conditionable liquid in the storing chambers 14 of the panel member 10, the panel member 10 which has been removed from the housing 3 is laid out flat and placed on a shelf or other support in a freezer or deepfreezer. By forming of the panel member 8 as a flat the plastic hinges 10 are formed with an in-built resilience for urging the panel segments 9 outwardly when the panel member 8 is bent to form the sleeve 11. In this way, the upper portions 43 and the intermediate portions 45 of the outer walls 39 of the panel segments 9 are urged into engagement with the bearing rim 20 of the inwardly tapering ring 17. Thus, as the bearing rim 20 is moved downwardly in the direction of the arrow B over the wedge-shaped portions 21 formed by the intermediate portions 45, the panel segments 9 are urged inwardly against the resilient action of the plastic hinges 10 for reducing the diameter of the receiving compartment 12. Additionally, the resilient action of the plastic hinges 10 urges the wedge-shaped portions 21 into engagement with the bearing rim 20 as the bearing rim 20 is being urged upwardly in the direction of the arrow D, thereby urging the panel segments 9 outwardly for increasing the diameter of the receiving compartment 12.

Charging ports 46 which are sealably closed by caps 47 are provided for charging the storing chambers 14 with the temperature conditionable liquid. The storing chambers 14 may be charged with the temperature conditionable liquid in the factory, and permanently sealed by the caps 47, or the caps 47 may be releaseably secured to the charging ports 46 for subsequent recharging of the storing chambers 14. The caps 47 slideably rest on the base 27 of the housing 3.

In this embodiment of the invention the temperature conditionable liquid as mentioned above is a mixture of water and glycerine, and is mixed in proportions to provide a liquid with a freezing point in the range of 0°C. to minus 20° C., and preferably, a freezing point of approximately −10° C. It is desirable that the freezing point of the liquid should be chosen to be sufficient to allow the temperature conditionable liquid in the storing chambers 14 to be frozen to a temperature sufficiently low for reducing the temperature of the wine bottle to the desired chill temperature within a reasonable period of time, and/or for maintaining the temperature of the wine bottle at the desired temperature. It is preferable that the temperature conditionable liquid should be frozen to its solid phase so that the benefit of latent heat as the temperature conditionable liquid returns from its solid phase to its liquid phase is utilised. Although, it is desirable that when freezing the temperature conditionable liquid, the temperature conditionable liquid when in its solid phase should not distort the panel segments 9 of the panel member 8, and in particular, should not distort the inner walls 38 so that maximum surface contact between the inner walls 38 and the wine bottle 2 is achieved. Were the inner walls 38 to be distorted by the temperature conditionable liquid in its solid phase, the area of the inner walls 38 in contact with the wine bottle 2 would be significantly reduced, and accordingly, when operating in the temperature altering mode for reducing the temperature of the wine bottle 2, the device 1 would operate relatively inefficiently. In order to optimise between availing of latent heat as the temperature conditionable liquid is converting from its solid phase to its liquid phase, on the one hand, and achieving maximum surface contact between the inner walls 38 of the panel segments 9 and the wine bottle 2, it is envisaged in certain cases, that the storing chambers 14 of alternate panel segments 9 may be charged with a temperature conditionable liquid with a freezing point lower than that in the storing chambers 14 of the other panel segments 9. This would allow the temperature conditionable liquid in the storing chambers 14 with the higher freezing point to be frozen solid, while temperature conditionable liquid in the storing chambers 14 with the lower freezing point temperature would be frozen to a slush ice state, in other words, in a state between the liquid phase and the solid phase. It is envisaged that such an arrangement would provide relatively good surface contact between the inner walls 38 of the panel segments 9 and the wine bottle 2.

A pair of handles 48 integrally injection moulded with the housing 3 extend radially outwardly on opposite sides of the housing 3 for carrying the cooling device 1.

In use, the panel member 8 is removed from the hollow interior region 5 and placed in a freezer or deepfreezer for chilling or freezing the temperature conditionable liquid in the storing chambers 14. Typically, the panel member 8 is laid out flat on a shelf or other support in a freezer or deepfreezer for freezing thereof. To remove the panel member 8, the annular ring 7 is rotated in the direction of the arrow C, see FIG. 2, until the cam followers 24 engage the lower ends 32 of the cam slots 30. The annular ring 7 and carrier sleeve 16 are then urged axially outwardly of the hollow interior region 5 until the carrier sleeve 16 disengages the housing 3 thereby facilitating removal of the panel member 8 for freezing thereof. On the temperature conditionable liquid in the storing chambers 14 of the panel member 8 being either frozen or at a desired temperature, the panel member 8 is formed into the sleeve 11 and inserted through the open mouth 6 into the hollow interior region 5. The carrier sleeve 16 is then inserted into the hollow interior region 5, care being taken to align the entry slots 33 with the corresponding cam followers 24. The annular ring 7 is pushed downwardly until the cam followers 24 engage the lower ends 32 of the cam slots 30, and the device 1 is ready for use.

A wine bottle or other beverage bottle or can is placed in the receiving compartment 12. If the diameter of the receiving compartment 12 is to be reduced, the annular ring 7 is rotated in the direction of the arrow A for urging the cam slots 30 past the cam followers 24 for in turn drawing the carrier sleeve 16 and the bearing rim 20 downwardly in the direction of the arrow B into the hollow interior region 5, for in turn reducing the diameter of the receiving compartment 12 to the desired diameter. When the upper ends 31 of the cam slots 30 engage the cam followers 24 the diameter of the receiving compartment is at a minimum.

Where it is desired to operate the device 1 in the first mode for reducing the temperature of the wine in the wine bottle from room temperature to the desired chill temperature, and a relatively rapid reduction in temperature of the wine is required, the diameter of the receiving compartment 12 formed by the panel member 8 is reduced so that the inner walls 38 of the panel segments 9 tightly abut the wine bottle 2. After the wine has been chilled to the desired chill temperature, and when it is desired to maintain the temperature of the wine at the desired chill temperature, the device 1 is operated in the second mode by increasing the diameter of the receiving compartment 12 so that the inner walls 38 of the panel segments 9 are spaced apart from the outer surface of the wine bottle 2. Indeed, where relatively slower chilling is desirable, the diameter of the receiving compartment 12 may be set so that the inner walls 38 of the panel segments 9 are slightly spaced apart from the wine bottle 2.

Referring now to FIGS. 13 to 20, there is illustrated a device according to another embodiment of the invention for regulating the temperature of the contents of a beverage container, which in this case is also a cooling device, which is indicated generally by the reference numeral 50 for cooling wine in a wine bottle (not shown). The cooling device 50 comprises a cylindrical housing 51 of stepped diameter at 62, which defines a hollow interior region 52, and forms an open mouth 53 to the main hollow interior region 52. An annular ring 54 is located at the open mouth 53 and is rotatably mounted on the housing 51. A panel member 55 which is substantially similar to the panel member 8 of the cooling device 1, described with reference to FIGS. 1 to 12, is located within the main hollow interior region 52 and defines a receiving compartment 56 within which the wine bottle is received. For convenience, since the panel member 55 is substantially similar to the panel member 8, similar components of the panel member 55 are identified by the same reference numerals as those of the panel member 8. In this embodiment of the invention, the outer walls 39 of the panel member 55 when formed into the sleeve 11 define a cylinder of constant diameter from top to bottom; in other words, the outer walls 39 of the panel member 8 are formed without the intermediate portion 45. The diameter of the receiving compartment 55 is variable as will be described below by rotation of the annular ring 54 relative to the housing 51.

The housing 51 comprises a base 57 and an upstanding side wall 58, which together form the hollow interior region 52. The side wall 58 of the housing 51 terminates at the open mouth 53 for releaseably and rotatably receiving and engaging the annular ring 54 by releaseably and rotatably engaging an annular recess 60 in the annular ring 54.

A downwardly extending projection 63 extends from the bottom wall 42 of the panel segment 9 adjacent one of the end edges 15 of the panel member 55, and releaseably engages a corresponding recess 64 in the base 57 of the housing 51. The panel member 55 is releaseably attached to the annular ring 54 adjacent the other end edge 15 of the panel member 55 so that on rotation of the annular ring 54 relative to the housing 51 through a relatively small angle, typically 20°, the end edges 15 of the panel member 55 are moved towards or away from each other for varying the diameter of the receiving compartment 56. A projection 65 extending sidewardly outwardly from the outer wall 39 of the panel segment 9 adjacent the end edge 15 at which the panel member 55 is connected to the annular ring 54 releaseably engages a corresponding slot 66 in a carrier lug 67 which extends downwardly from the annular ring 54 into the hollow interior region 52. An abutment member 68 extends downwardly from the annular ring 54, and is spaced apart from the carrier lug 67 for tightly abutting the inner wall 38 of the panel member 55 for retaining the sidewardly extending projection 65 in engagement with the slot 66 of the carrier lug 67.

The inner walls 38 of the panel member 55 are inclined upwardly outwardly adjacent the open mouth 53 for forming a tapered lead-in 69 for accommodating the wine bottle into the receiving compartment 56. Removal of the panel member 55 from the main hollow interior region 52 for freezing thereof is carried out by removing the annular ring 54 from the housing 51. On replacing the panel member 55 in the hollow interior region 52, the projection 63 is engaged in the recess 64 in the base 57 of the housing 51. The annular ring 54 is then engaged in the open mouth 53 of the housing 51 with the slot 66 of the carrier lug 67 engaging the projection 65.

In use, the diameter of the receiving compartment 56 is varied by rotating the annular ring 54 relative to the housing 51 in the appropriate direction for urging the end edges 15 of the panel member 55 towards or away from each other, depending on whether the diameter of the receiving compartment 56 is to be reduced or increased. The cooling device 50 can be operated in the two modes, namely, the first mode for chilling wine in the wine bottle with the panel member 55 abutting the wine bottle, and in the second mode with the panel member 55 slightly spaced apart from the wine bottle for maintaining the temperature of the wine bottle at a desired chilled temperature.

One difference between the cooling device 50 and the cooling device 1 is that in the case of the cooling device 1 as the diameter of the receiving compartment 12 is being varied, the sleeve 11 formed by the panel member 8 remains concentric with the cylindrical housing 3 and the annular ring 7. On the other hand, in the case of the cooling device 50, if when at its maximum diameter the receiving compartment 56 is concentric with the housing 51 and the annular ring 54, see FIG. 17, as the diameter of the receiving compartment 56 is reduced, the receiving compartment 56 becomes eccentric relative to the housing 51 and the annular ring 54, see FIG. 16. The more the diameter of the receiving compartment 56 is reduced the more eccentric the receiving compartment 56 becomes. On the other hand, at its smallest diameter, if the receiving compartment 56 is concentric with the housing 51, increasing the diameter of the receiving compartment 56 causes the receiving compartment 56 to become eccentric relative to the housing 51. This, it will be understood, is a slight disadvantage of the cooling device 50 relative to the cooling device 1.

Referring now to FIGS. 21 and 22, there is illustrated a portion of a device for regulating the temperature of the contents of a beverage container, in this case, a cooling device according to another embodiment of the invention indicated generally by the reference numeral 70 for cooling a wine bottle. The cooling device 70 is substantially similar to the cooling device 1 but is a more simplified version of the cooling device 1. For convenience, components of the cooling device 70 which are similar to the cooling device 1 are indicated by the same reference numerals. In the cooling device 70, the cam followers 24 and the cam slots 30 are dispensed with, and the carrier sleeve 16 extends downwardly into the hollow interior region 5 from the annular ring 7. The carrier sleeve 8 terminates in the first element which is provided by a wedge-shaped bearing rim 71. The bearing rim 71 co-operates with the wedge-shaped portions 21 of the panel member 8 for varying the diameter of the receiving compartment 12. To vary the diameter of the receiving compartment 12, the annular ring 7, and in turn the carrier sleeve 16 are urged axially inwardly into or outwardly out of the main hollow interior region 5 for causing the bearing rim 71 of the carrier sleeve 16 to co-operate with the wedge-shaped portions 21 of the panel member 8 for varying the diameter of the receiving compartment 12. The more the carrier sleeve 16 is urged inwardly into the hollow interior region 5 the more the diameter of the receiving compartment 12 is reduced and vice versa.

Referring now to FIGS. 23 to 25, there is illustrated device for regulating the temperature of the contents of a beverage container, namely, a cooling device according to a still further embodiment of the invention which is indicated generally by the reference numeral 75 for cooling a wine bottle. The cooling device 75 comprises a cylindrical housing 76 which extends upwardly from and is releaseably engageable in a groove 83 a base 77. Both the cylindrical housing 76 and the base 77 are of injection moulded plastics material, and together when assembled define a hollow interior region 78 for receiving a panel member 79 which is substantially similar to the panel member 8 of the cooling device 1. For convenience, because of the similarity between the panel member 79 and the panel member 8 of the cooling device 1, components of the panel member 79 which are similar to the panel member 8 are identified by the same reference numerals. A central boss 80 projecting upwardly from the base 77 into the hollow interior region 78 locates and centres the panel member 79 in the main hollow interior region 78 when formed into the sleeve 11. The central boss 80 also engages the panel member 79 when the sleeve 11 defines the receiving compartment 12 of smallest diameter.

An urging means for urging the panel member 79 when forming the sleeve 11 into engagement with the central boss 80 comprises a pair of resilient rings 81 of resilient plastics material, in this embodiment of the invention closed cell foam plastics material. The rings 81 are secured to the housing 76 adjacent the top and bottom respectively for abutting the outer walls 39 of the panel segments of the panel member 79. The inner walls 38 incline upwardly outwardly adjacent the open mouth of the housing 76 for forming a tapered lead-in for facilitating entering of a wine bottle into the receiving compartment 12. The rings 81 are compressed by the action of a wine bottle on the inner walls 38 of the panel member 79 for permitting the sleeve 11 to form the receiving compartment 12 with a diameter which substantially coincides with the diameter of the bottle being cooled. Additionally, the rings 81 urge the panel member 79 into engagement with the bottle being cooled so that the inner walls 38 of the panel member 79 relatively tightly abut the bottle.

An inwardly directed lip 82 extends around the open mouth of the cylindrical housing 76 for retaining the panel member 79 in the hollow interior region 78.

To remove the panel member 79 from the hollow interior region 78 for freezing thereof the housing 76 is disengaged from the base 77, and the panel member 79 is withdrawn from the hollow interior region 78 at the lower end thereof.

Otherwise, operation of the cooling device 75 is substantially similar to the cooling devices already described, with the exception that the diameter of the receiving compartment 12 formed by the panel member 79 is effectively automatically varied by the co-operating action of the wine bottle on the inner walls 38 of the panel member 79 and the action of the resilient rings 81 on the outer walls 39 of the panel member 79. However, one difference between the cooling device 75 and the cooling devices already described with reference to FIGS. 1 to 22 is that it is not possible to operate the cooling device 75 in the second mode with the inner walls 38 of the panel member 79 spaced apart from the wine bottle, since the urging action of the resilient rings 81 is such as to urge the panel member 79 towards the wine bottle so that the inner walls 38 abut the outer surface of the wine bottle.

Referring now to FIGS. 26 and 27 there is illustrated a device according to another embodiment of the invention for regulating the temperature of the contents of a beverage container, which in this case is also a cooling device 85 for cooling a wine bottle 2. The cooling device 85 is substantially similar to the cooling device 1, and similar components are identified by the same reference numerals. The main difference between the cooling device 85 and the cooling device 1 is that the constraining means for constraining the bearing rim 20 of the carrier sleeve 16 to move axially into and out of the hollow interior region 5 is formed by a pair of co-operating screw threads, one of which screw thread 86 is formed on the carrier sleeve 16, and the other of which screw thread 87 is formed on the side wall 28 of the housing 3. The diameter of the receiving compartment 12 of the panel member 8 is varied by rotating the annular ring 7, and in turn the carrier sleeve 16.

To remove the panel member 8 from the housing 3 the carrier sleeve 16 is withdrawn entirely from the housing 3 by rotation thereof in an anti-clockwise direction.

Otherwise, operation of the cooling device 85 is identical to that of the cooling device 1.

While the devices for regulating the temperature of the contents of a bottle have been described for chilling the contents of a wine bottle, it will be readily apparent to those skilled in the art that the devices may be used for regulating the temperature of the contents of any other bottle, can or other container whether beverage of otherwise.

It will also be appreciated that the devices for regulating the temperature of a bottle may be used for heating the contents of a bottle or other container above room temperature and/or for maintaining the temperature of the contents of a bottle or other container above room temperature, in which case, instead of chilling or freezing the temperature conditionable liquid in the storing chambers of the panel member, the temperature conditionable liquid would be heated to or above the temperature at which it is desired to increase or maintain the contents of the bottle or other container.

It is also envisaged that in the devices illustrated and described with reference to FIGS. 23 to 25, the resilient rings may be replaced with a spring loaded ring, for example, a resilient C-ring or C-rings, which would be located around the outer peripheral surface defined by the outer walls of the panel member for urging the panel member into engagement with a wine bottle or other container.

What is claimed is:

1. A device (1,50,70,75,85) for regulating the temperature of the contents of a container (2), the device comprising a support means (3,51,76), and a temperature regulating means (8,55,79) located within the support means (3,51,76) for regulating the temperature of the contents of the container (2) at a desired temperature, the temperature regulating means (8,55,79) comprising a storing means (14) for storing a temperature conditionable fluid and defining an elongated receiving compartment (12) for receiving the container (2), the receiving compartment (12) being of variable transverse cross-sectional area for accommodating containers (2) of different cross-sectional area, characterised in that the support means (3,51,76) comprises a first part (3,51,76) and a second part (7,54) which are moveable relative to each other, the second part (7,54) of the support means (3,51,76) being co-operable with the temperature regulating means (8,55,79) so that relative movement of the first and second parts (3,51,76) (7,54) varies the transverse cross-sectional area of the receiving compartment (12).

2. A device as claimed in claim 1 characterised in that the transverse cross-sectional area of the receiving compartment (12) is variable for facilitating operation of the device (1,50,70,85) in a first mode with the temperature regulating means (8,55) abutting the container (2) for altering the temperature of the contents of the container (2), and in a second mode with the temperature regulating means (8, 55) spaced apart from the container (2) for maintaining the temperature of the contents of the container (2) substantially constant.

3. A device as claimed in claim 1 characterised in that the receiving compartment (12) defines a central axis (4) which in use substantially coincides with the central axis (4) of the container (2).

4. A device as claimed in claim 1 characterised in that the receiving compartment (12) is in the form of an elongated receiving bore of circular transverse cross-sectional area.

5. A device as claimed in claim 1 characterised in that the first part (3,51,76) of the support means comprises a hollow housing (3,51,76) which forms a container defining a hollow interior region (5,52,78) for receiving the temperature regulating means therein (8,55,79), the housing (3,51,76) defining a longitudinally extending central axis (4) which substantially coincides with the central axis (4) of the receiving compartment (12), and the second part (7,54) of the support means comprises an annular ring (7,54) located co-axially with the housing (3,51,76).

6. A device as claimed in claim 1 characterised in that a first element (20,67) is located on the second part (7,54) of the support means and a second element (21,65) is located on the temperature regulating means so that on relative movement of the first and second parts of the support means the first and second elements co-operate with each other for varying the transverse cross-sectional area of the receiving compartment (12), the first element (20) being moveable relative to the second element (21) for varying the transverse cross-sectional area of the receiving compartment (12) as one of the first and second Darts (3,7) of the support means is moved relative to the other.

7. A device as claimed in claim 6 characterised in that the second element (21) is shaped so that movement of the first element (20) relative to the second element (21) varies the transverse cross-sectional area of the receiving compartment (12), and a constraining means (23,24,86,87) is provided for constraining the first element (20) to move in a predetermined path relative to the second element (21) for varying the transverse cross-sectional area of the receiving compartment (12) when one of the first and second tarts (3,7) of the support means is moved relative to the other, and the first and second Darts (7,54) of the support means are rotatably moveable relative to each other, and the constraining means (23,24,86,87) constrains the first element (20) to move relative to the second element (21) along the predetermined path parallel to the central axis (4).

8. A device as claimed in claim 7 characterised in that the constraining means (23,24,86,87) comprises a cam drive means (23,24) having a camming means (23) located on one of the first and second parts of the support means, and a cam follower (24) located on the other of the first and second parts of the support means, the cam follower (24) being co-operable with the camming means (23) for constraining the first element (20) to move in the predetermined path relative to the second element (21) for varying the transverse cross-sectional area of the receiving compartment (12) on one of the first and second parts of the support means being moved relative to the other.

9. A device as claimed in claim 6 characterised in that the annular ring (7,54) is rotatably moveable relative to the housing (3,51) for causing the first element (20) to move relative to the second element (21) along the predetermined path, and the annular ring (7,54) is rotatable moveable relative to the housing (3,51) from a first annular position with the receiving compartment (12) of the temperature regulating means (8,55,79) being of maximum transverse cross-sectional area to a second angular position with the receiving compartment (12) of the temperature regulating means (8,55,79) being of minimum transverse cross-sectional area.

10. A device as claimed in claim 9 characterised in that the housing (3,51,76) comprises a base (27,57,77) and an upwardly extending side wall (28,58) which defines an open mouth (6,53) to the hollow interior region (5,52,78), the side wall (28,58) defining the central axis (4) of the hollow interior region (5,52,78), and the annular ring (7,54) being located above the housing adjacent the open mouth (6,53), and a carrier means (16,67) extends from the annular ring into the hollow interior region of the housing for carrying the first element (20,66), and the carrier means (16) carries one of the camming means (23) and the cam follower (24), and the other of the camming means (23) and the cam follower (24) is carried on the housing (3), and the camming means (23) is provided by a cam slot (30) formed in the carrier means (16), the cam slot (30) extending partially circumferentially around the carrier means (16) and defining a cam profile (23) for engagement with the cam follower (24) so that rotation of the annular ring (7) and the carrier means (16) relative to the housing (3) constrains the carrier means (16) to move parallel to the central axis (4) of the receiving compartment (12) for varying the transverse cross-sectional area of the receiving compartment (12).

11. A device as claimed in claim 10 characterised in that the cam follower (24) is located on the housing (3) and extends inwardly into the hollow interior region (5) for engaging the cam profile (23) defined by the cam slot (30).

12. A device as claimed in claim 10 characterised in that a plurality of cam followers (24) are equi-spaced apart circumferentially around the housing (3), and a corresponding number of cam slots (30) are also provided equi-spaced apart around the carrier means (16), and each cam slot (30) defines an inclined cam profile (23) relative to the central axis (4) of the receiving compartment (12), and an entry slot (33) is provided to each cam slot (30) for facilitating exiting and entry of the corresponding cam follower (24) into the cam slot (30) on removal or replacement of the annular ring (7) and carrier means (16) relative to the housing (3), the entry slots (33) communicating with the corresponding cam slots (30) at the end (32) of the cam slots (30) remote from the annular ring (7) and extending in an axial direction away from the annular ring (7) towards the free end of the carrier means (16).

13. A device as claimed in claim 10 characterised in that the carrier means (16) extends from the annular ring into the hollow interior region (5) of the housing (3), and the carrier means (16) is located between the housing (3) and the temperature regulating means (8).

14. A device as claimed in claim 10 characterised in that the carrier means (16) comprises a carrier side wall extending from the annular ring (7) between the housing (3) and the temperature regulating means (8), the carrier side wall terminating in a bearing rim (20) at its free end remote from the annular ring (7) which forms the first element (20), the bearing rim (20) extending completely around the carrier side wall (16), and being formed on a portion (17) of the carrier side wall (16) extending inwardly towards the temperature regulating means (8).

15. A device as claimed in claim 6 characterised in that the temperature regulating means (8,55,79) defines an outer face (39), the outer face (39) defining the second element (21,45) for co-operating with the first element (20) for varying the transverse cross-sectional area of the receiving compartment (12), the second element (21,45) defined by the outer face (39) being of wedge-shape in a direction parallel to the central axis (4) of the receiving compartment (12)50 that axial movement of the first element (20) relative to the second element (21,45) varies the transverse cross-sectional area of the receiving compartment (12).

16. A device as claimed in claim 1 characterised in that the first part (51) of the support means (51) is connected to the temperature regulating means (55) at a first location (63), and the second part (54) of the support means (51) is connected to the temperature regulating means (55) at a spaced apart second location (65), so that movement of one of the first and second parts (51,54) of the support means relative to the other varies the transverse cross-sectional area of the receiving compartment (12).

17. A device as claimed in claim 16 characterised in that the first part (51) of the support means is connected to the temperature regulating means (55) adjacent to one of a pair of free longitudinally extending end edges (15) of the temperature regulating means (55), and the second part (54) of the support means (51) is connected to the temperature regulating means (55) adjacent to the other of the free longitudinally extending end edges (15) of the temperature regulating means (55), and the first location (63) of the temperature regulating means (55) is connected to the base (57) of the housing (51) of the support means and the second location (65) is connected to the annular ring (54) of the support means adjacent the top of the temperature regulating means (55) so that rotation of the annular ring (54) relative to the housing (51) causes the respective end edges (15) to move relative to each other for varying the transverse cross-sectional area of the receiving compartment (12).

18. A device as claimed in claim 1 characterised in that the temperature regulating means (8,55,79) is freely supported in the support means (3,51,76), and the temperature regulating means (8,55,79) is releaseably retained in the support means (3,51,76) for facilitating removal thereof for locating the temperature regulating means (8,55,79) in an appropriate environment for conditioning the temperature conditionable fluid prior to use, and the temperature regulating means (8,55,79) defines a pair of free longitudinally extending end edges (15) extending parallel to the central axis (4) of the receiving compartment (12), the free end edges (15) being moveable relative to each other for varying the transverse cross-sectional area of the receiving compartment (12), and the temperature regulating means (8,55,79) comprises a panel member (8) formed into a sleeve (11) for forming the receiving compartment (12), the panel member (8) defining the pair of opposite longitudinally extending free end edges (15) extending parallel to the central axis (4) of the receiving compartment which form the end edges (15), and the panel member (8,55,79) comprises a plurality of elongated panel segments (9) extending parallel to the central axis (4) of the receiving compartment (12), each panel segment (9) defining an inner face (38) and an opposite outer face (39) which are joined by a pair of opposite longitudinally extending end faces (40), the outer faces (39) of the respective panel segment (9) defining the outer face (39) of the temperature regulating means (8,55,79), each panel segment (9) being connected to its adjacent panel segment (9) by a connecting means (10), the inner faces (38) of the respective panel segments (9) defining the receiving compartment (12), and the end faces (40) of the panel segments (9) at respective opposite ends of the panel member (8,55,79) defining the respective free end edges (15) of the panel member (8,55, 79), and each panel segment (9) defines a discrete storing chamber (14) for forming the storing means for storing the temperature conditionable fluid.

19. A device as claimed in claim 18 characterised in that alternate storing chambers (14) of the panel member (8,55, 79) are charged with respective temperature conditionable fluids with different freezing points so that when the temperature conditionable fluid of some of the storing chambers (14) is frozen to a solid phase, the temperature conditionable fluid in the alternate storing chambers (14) is not in a solid phase, and the temperature conditionable fluid in the alternate storing chambers (14) which is not frozen solid is in a slush ice phase, and the connecting means (10) for connecting adjacent panel segments (9) is a resilient connecting means (10) for urging the panel member (8,55,79) outwardly relative to the central axis (4) of the receiving compartment (12), each connecting means (10) comprising a longitudinally extending plastics hinge (10), and being located intermediate the inner and outer faces (38,39) of the adjacent panel segments (9), and preferably, the end faces (40) of the respective panel segments (9) between the connecting means (10) and the inner faces (38) of the panel segments (9) are chamfered for accommodating hinging of the panel segments (9) relative to each other for forming the receiving compartment (12).

20. A device as claimed in claim 1 characterised in that the storing means (14) is charged with the temperature conditionable fluid, and the temperature conditionable fluid is a temperature conditionable liquid, the temperature conditionable liquid being a liquid which is chillable with a freezing point at or below that of water, and preferably, the freezing point of the chillable liquid lies in the range between 0° C. and −20° C., and preferably, the temperature conditionable liquid comprises a mixture of water and any one or more of the following ingredients:

glycerine, saline solution, and propylene glycol.

21. A device for regulating the temperature of the contents of a container, the device comprising:

a support means comprising a first part, and a second part, the respective first and second parts being moveable relative to each other, and a temperature regulating means located within the support means for regulating the temperature of the contents of the container at a desired temperature, the temperature regulating means comprising:

a storing means for storing a temperature conditionable fluid and defining an elongated receiving compartment for receiving the container, the receiving compartment being of variable transverse cross-sectional area for accommodating containers of different cross-sectional area, the temperature regulating means being co-operable with the second part of the support means so that relative movement of the first and the second parts of the support means varies the transverse cross-sectional area of the receiving compartment.

22. A device as claimed in claim 21 in which the transverse cross-sectional area of the receiving compartment is variable for facilitating operation of the device in a first mode with the temperature regulating means abutting the container for altering the temperature of the contents of the container, and in a second mode with the temperature regulating means spaced apart from the container for maintaining the temperature of the contents of the container substantially constant.

23. A device as claimed in claim 21 in which the receiving compartment defines a central axis which in use substantially coincides with the central axis of the container.

24. A device as claimed in claim 21 in which the receiving compartment is in the form of an elongated receiving bore of circular transverse cross-sectional area.

25. A device as claimed in claim 21 in which the first part of the support means comprises a hollow housing which forms a container defining a hollow interior region for receiving the temperature regulating means therein, the housing defining a longitudinally extending central axis which substantially coincides with the central axis of the receiving compartment, and the second part of the support means comprises an annular ring located coaxially with the housing.

26. A device as claimed in claim 21 in which a first element is located on the second part of the support means and a second element is located on the temperature regulating means so that on relative movement of the first and second parts of the support means the first and second elements co-operate with each other for varying the transverse cross-sectional area of the receiving compartment, the first element being moveable relative to the second element for varying the transverse cross-sectional area of the receiving compartment as one of the first and second parts of the support means is moved relative to the other.

27. A device as claimed in claim 26 in which the second element is shaped so that movement of the first element relative to the second element varies the transverse cross-sectional area of the receiving compartment, a constraining means being provided for constraining the first element to move in a predetermined path relative to the second element for varying the transverse cross-sectional area of the receiving compartment when one of the first and second parts of the support means is moved relative to the other, and the first and second parts of the support means are rotatably moveable relative to each other, and the constraining means constrains the first element to move relative to the second element along the predetermined path parallel to the central axis.

28. A device as claimed in claim 27 in which the constraining means comprises a cam drive means having a camming means located on one of the first and second parts of the support means, and a cam follower located on the other of the first and second parts of the support means, the cam follower being co-operable with the camming means for constraining the first element to move in the predetermined path relative to the second element for varying the transverse cross-sectional area of the receiving compartment on one of the first and second parts of the support means being moved relative to the other.

29. A device as claimed in claim 26 when dependent on claim 25 in which the annular ring is rotatably moveable relative to the housing for causing the first element to move relative to the second element along the predetermined path, and the annular ring is rotatably moveable relative to the housing from a first angular position with the receiving compartment of the temperature regulating means being of maximum transverse cross-sectional area to a second angular position with the receiving compartment of the temperature regulating means being of minimum transverse cross-sectional area.

30. A device as claimed in claim 26 when dependent on claim 25 in which the annular ring is rotatably moveable relative to the housing for causing the first element to move relative to the second element along the predetermined path, and the annular ring is rotatably moveable relative to the housing from a first angular position with the receiving compartment of the temperature regulating means being of maximum transverse cross-sectional area to a second angular position with the receiving compartment of the temperature regulating means being of minimum transverse cross-sectional area.

31. A device as claimed in claim 30 in which the housing comprises a base and an upwardly extending side wall which defines an open mouth to the hollow interior region, the side wall defining the central axis of the hollow interior region, and the annular ring being located above the housing adjacent the open mouth, and a carrier means extends from the annular ring into the hollow interior region of the housing for carrying the first element, and the carrier means carries one of the camming means and the cam follower, and the other of the camming means and the cam follower is carried on the housing, and the camming means is provided by a cam slot formed in the carrier means, the cam slot extending partially circumferentially around the carrier means and defining a cam profile for engagement with the cam follower so that rotation of the annular ring and the carrier means relative to the housing constrains the carrier means to move parallel to the central axis of the receiving compartment for varying the transverse cross-sectional area of the receiving compartment.

32. A device as claimed in claim 31 in which the cam follower is located on the housing and extends inwardly into the hollow interior region for engaging the cam profile defined by the cam slot.

33. A device as claimed in claim 31 in which a plurality of cam followers are equi-spaced apart circumferentially around the housing, and a corresponding number of cam slots are also provided equi-spaced apart around the carrier means, and each cam slot defines an inclined cam profile relative to the central axis of the receiving compartment, and an entry slot is provided to each cam slot for facilitating exiting and entry of the corresponding cam follower into the cam slot on removal or replacement of the annular ring and carrier means relative to the housing, the entry slots communicating with the corresponding cam slots at the end of the cam slots remote from the annular ring and extend in an axial direction away from the annular ring towards the free end of the carrier means.

34. A device as claimed in claim 31 in which the carrier means extends from the annular ring into the hollow interior region of the housing, and the carrier means is located between the housing and the temperature regulating means.

35. A device as claimed in claim 31 in which the carrier means comprises a carrier side wall extending from the annular ring between the housing and the temperature regulating means, the carrier side wall terminating in a bearing rim at its free end remote from the annular ring which forms the first element, the bearing rim extending completely around the carrier side wall, and is formed on a portion of the carrier side wall extending inwardly towards the temperature regulating means.

36. A device as claimed in claim 26 in which the temperature regulating means defines an outer face, the outer face defining the second element for co-operating with the first element for varying the transverse cross-sectional area of the receiving compartment, and the second element defined by the outer face is of wedge-shape in a direction parallel to the central axis of the receiving compartment so that axial movement of the first element relative to the second element varies the transverse cross-sectional area of the receiving compartment.

37. A device as claimed in claim 21 in which the first part of the support means is connected to the temperature regulating means at a first location, and the second part of the support means is connected to the temperature regulating means at a spaced apart second location, so that movement of one of the first and second parts of the support means relative to the other varies the transverse cross-sectional area of the receiving compartment.

38. A device as claimed in claim 37 in which the first part of the support means is connected to the temperature regulating means adjacent to one of a pair of free longitudinally extending end edges of the temperature regulating means, and the second part of the support means is connected to the temperature regulating means adjacent to the other of the free longitudinally extending end edges of the temperature regulating means, and the first location of the temperature regulating means is connected to the base of the housing of the support means and the second location is connected to the annular ring of the support means adjacent the top of the temperature regulating means so that rotation of the annular ring relative to the housing causes the respective end edges to move relative to each other for varying the transverse cross-sectional area of the receiving compartment.

39. A device as claimed in claim 21 in which the temperature regulating means is freely supported in the support means, and the temperature regulating means is releaseably retained in the support means for facilitating removal thereof for locating the temperature regulating means in an appropriate environment for conditioning the temperature conditionable fluid prior to use, and the temperature regulating means defines a pair of free longitudinally extending end edges extending parallel to the central axis of the receiving compartment, the free end edges being moveable relative to each other for varying the transverse cross-sectional area of the receiving compartment, and the temperature regulating means comprises a panel member formed into a sleeve for forming the receiving compartment, the panel member defining the pair of opposite longitudinally extending free end edges extending parallel to the central axis of the receiving compartment which form the end edges, and the panel member comprises a plurality of elongated panel segments extending parallel to the central axis of the receiving compartment, each panel segment defining an inner face and an opposite outer face which are joined by a pair of opposite longitudinally extending end faces, the outer faces of the respective panel segment defining the outer face of the temperature regulating means, each panel segment being connected to its adjacent panel segment by a connecting means, the inner faces of the respective panel segments defining the receiving compartment, and the end faces of the panel segments at respective opposite ends of the panel member defining the respective free end edges of the panel member, each panel segment defining a discrete storing chamber for forming the storing means for storing the temperature conditionable fluid.

40. A device as claimed in claim 39 in which alternate storing chambers of the panel member are charged with respective temperature conditionable fluids with different freezing points so that when the temperature conditionable fluid of some of the storing chambers is frozen to a solid phase, the temperature conditionable fluid in the alternate storing chambers is not in a solid phase, and the temperature conditionable fluid in the alternate storing chambers which is not frozen solid is in a slush ice phase, and the connecting means for connecting adjacent panel segments is a resilient connecting means for urging the panel member outwardly relative to the central axis of the receiving compartment, each connecting means comprising a longitudinally extending plastics hinge, and being located intermediate the inner and outer faces of the adjacent panel segments, the end faces of the respective panel segments between the connecting means and the inner faces of the panel segments being chamfered for accommodating hinging of the panel segments relative to each other for forming the receiving compartment.

41. A device as claimed in claim 21 in which the storing means is charged with the temperature conditionable liquid, the temperature conditionable liquid is a liquid which is chillable with a freezing point in the range between 0° C. and −20° C., and comprises a mixture of water and any one or more of the following ingredients:

glycerine, saline solution, and propylene glycol.

* * * * *